United States Patent [19]

Schneider

[11] 4,057,951

[45] Nov. 15, 1977

[54] PACKAGING MACHINE

[75] Inventor: Walter Max Schneider, Lansing, Ill.

[73] Assignee: Land O'Frost Inc., Lansing, Ill.

[21] Appl. No.: 763,297

[22] Filed: Jan. 28, 1977

[51] Int. Cl.[2] ..... B65B 57/06; B65B 57/12; B65B 31/02

[52] U.S. Cl. ..... 53/55; 53/86; 53/112 B; 53/131; 53/188; 53/373; 53/385

[58] Field of Search ..... 53/55, 86, 95, 112 R, 53/112 B, 131, 188, 373, 385

[56] References Cited

U.S. PATENT DOCUMENTS

| | | | |
|---|---|---|---|
| 3,910,009 | 10/1975 | Canfield | 53/112 B |
| 4,014,153 | 3/1977 | Wilson | 53/112 B X |

*Primary Examiner*—Travis S. McGehee

*Attorney, Agent, or Firm*—Dominik, Knechtel, Godula & Demeur

[57] ABSTRACT

An improved automatic and continuous packaging machine is disclosed formed by a support table supporting a turret, the turret being generally hexagonal in configuration said machine further including a plurality of six processing stations for processing a food package, including a first station provided with a magazine for containing a plurality of food pouches, and deposition means for retrieving and depositing a single food pouch on the turret, a second processing station for automatically imprinting upon the food pouch pre-determined indicia, and also including pouch opening means for opening the pouch to its substantial dimension, a third processing station provided with protection means for determining the presence of a properly opened food pouch and in response to the proper signal, food loading means for loading a food product into the open food pouch. A fourth processing station is provided with ejection means for ejecting any pouches which have been determined at the third station to be improperly opened. A fifth processing station includes an improved vacuum hood assembly supported by a self-positioning carriage and carrying within the confines of the hood the vacuum and nitrogen purging and sealing means for sealing the food package, and a sixth processing station for effecting the discharge of the completed food package from the turret for further handling. The invention further provides an improved vacuum hood assembly as well as an improved heat sealing bar assembly whereby a food package may be automatically loaded onto the turret, imprinted, filled, purified, the package heat sealed, and discharged for subsequent packing operations.

42 Claims, 33 Drawing Figures

FIG. 1
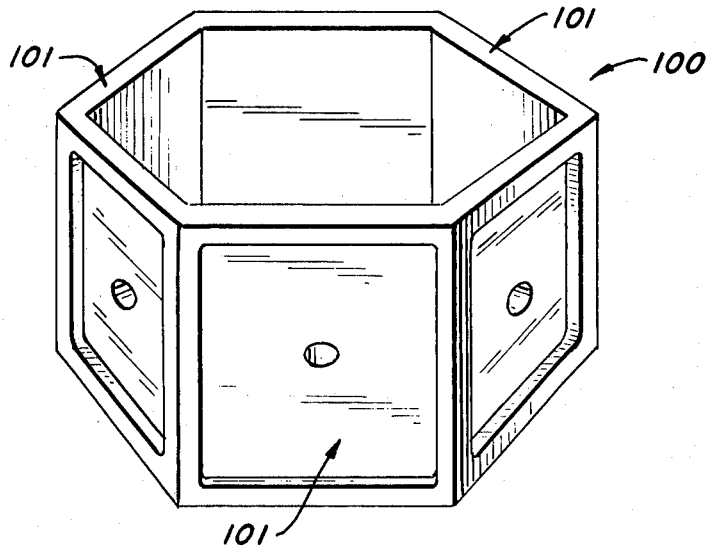
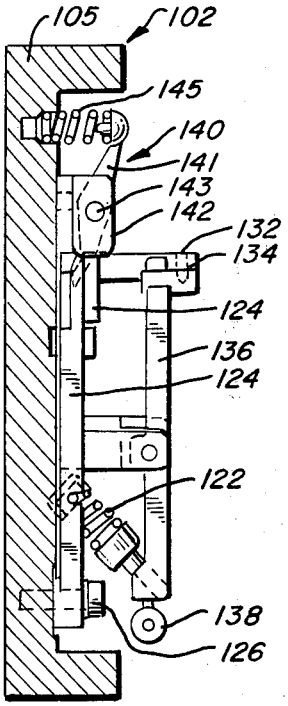
FIG. 2
FIG. 3
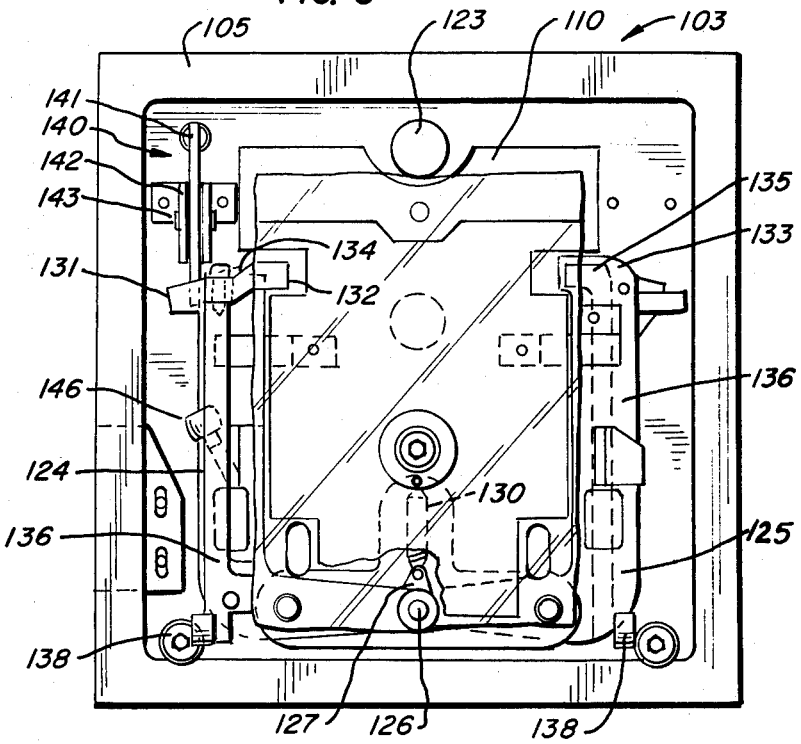
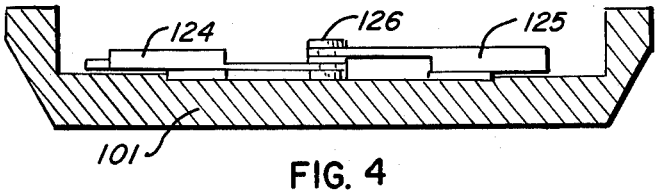
FIG. 4

FIG. 5
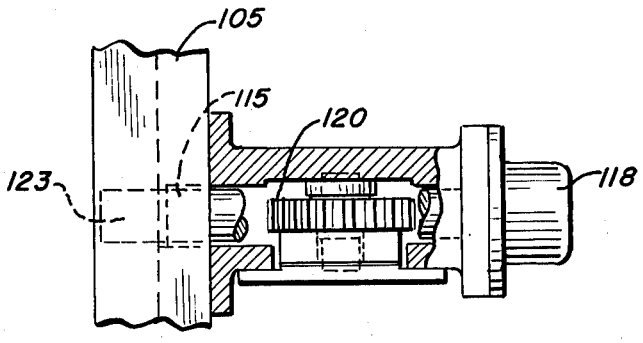
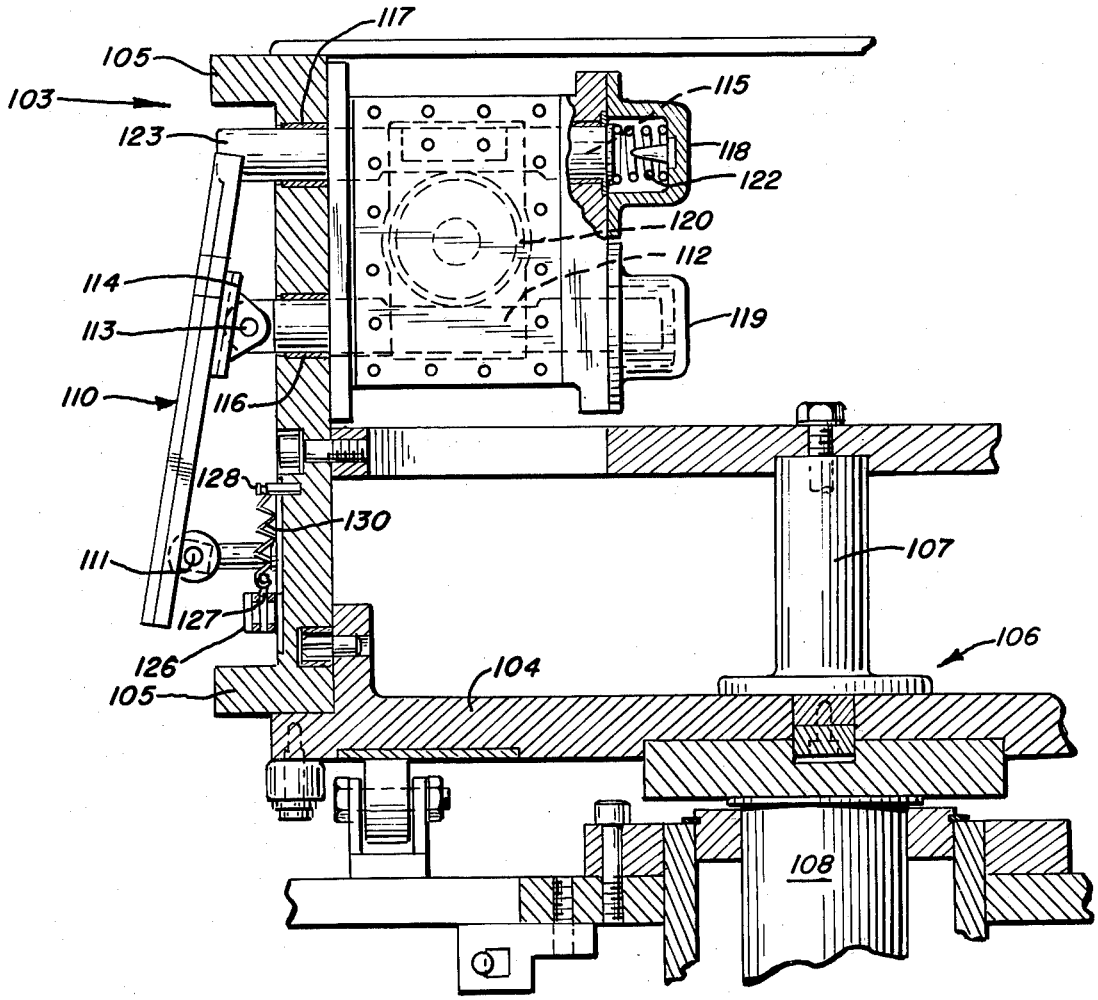
FIG. 6

FIG. 9
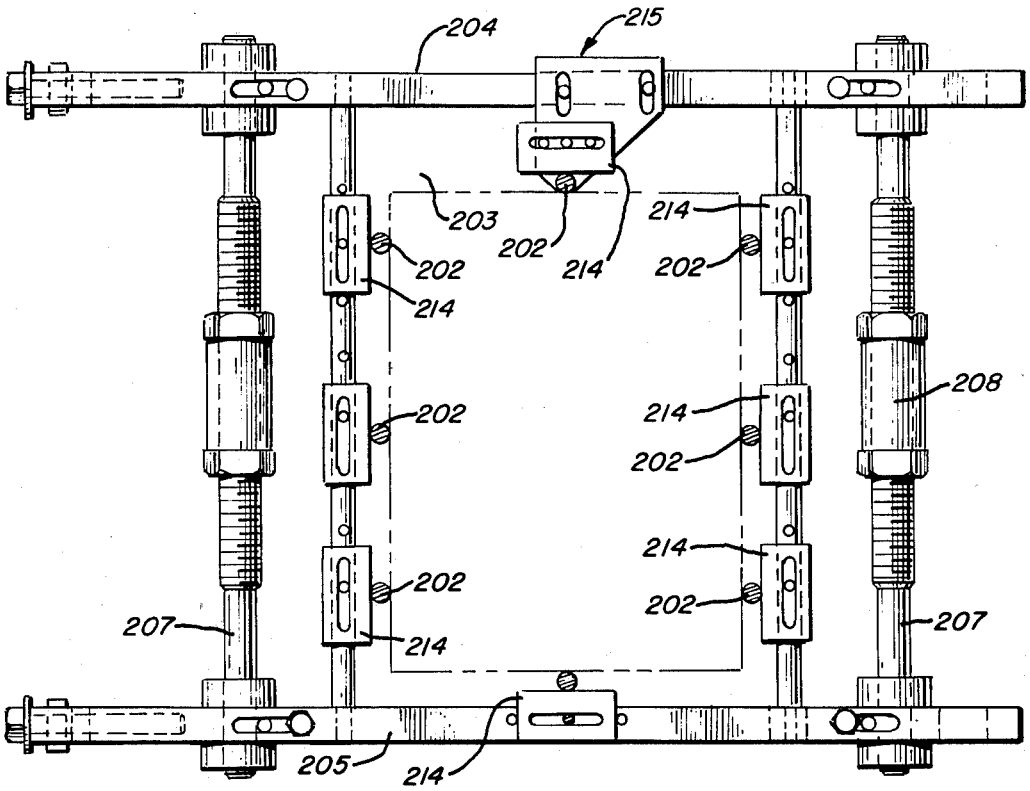
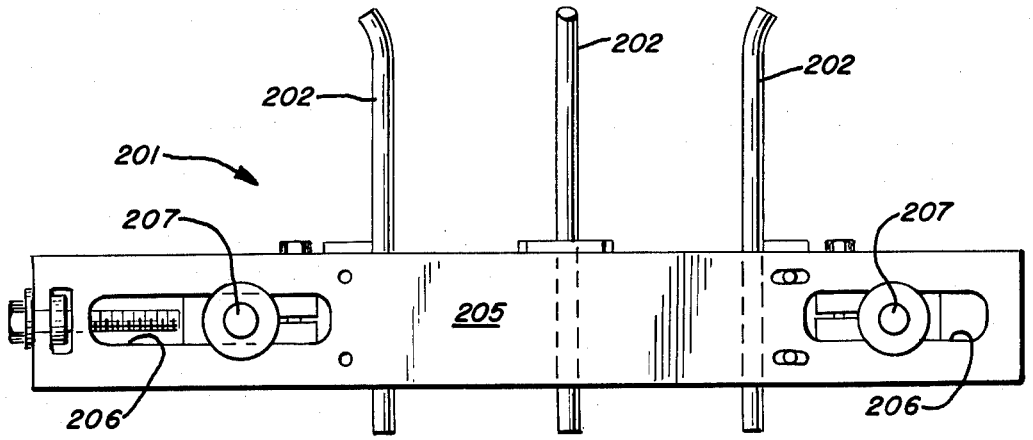
FIG. 10

FIG. 13
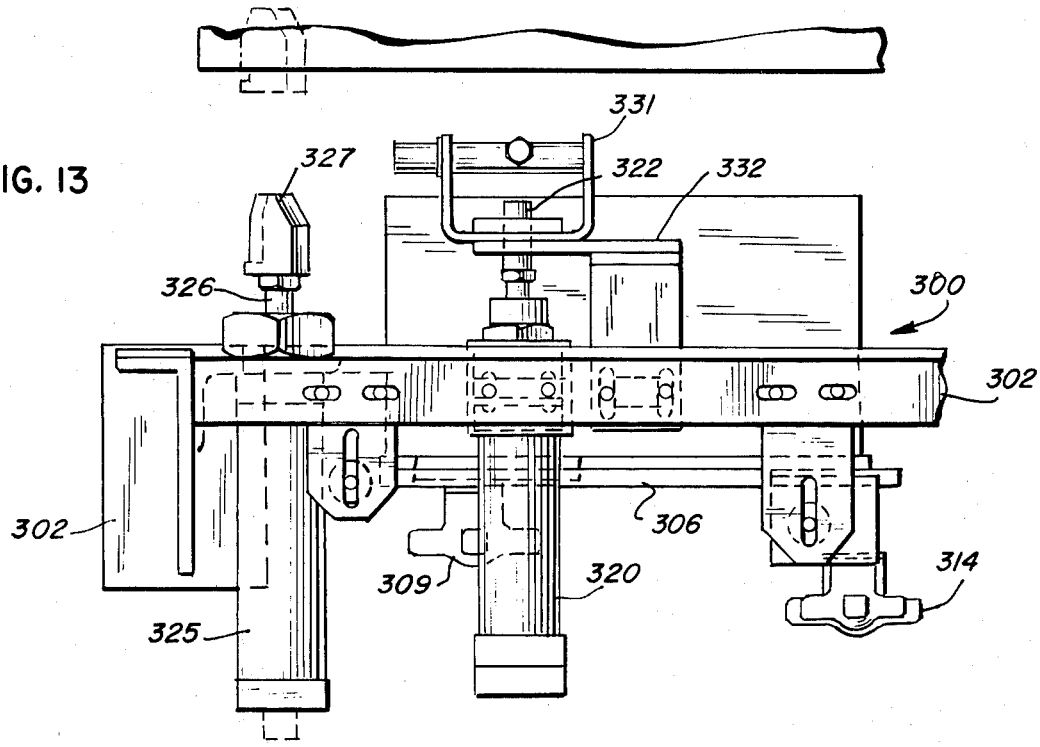
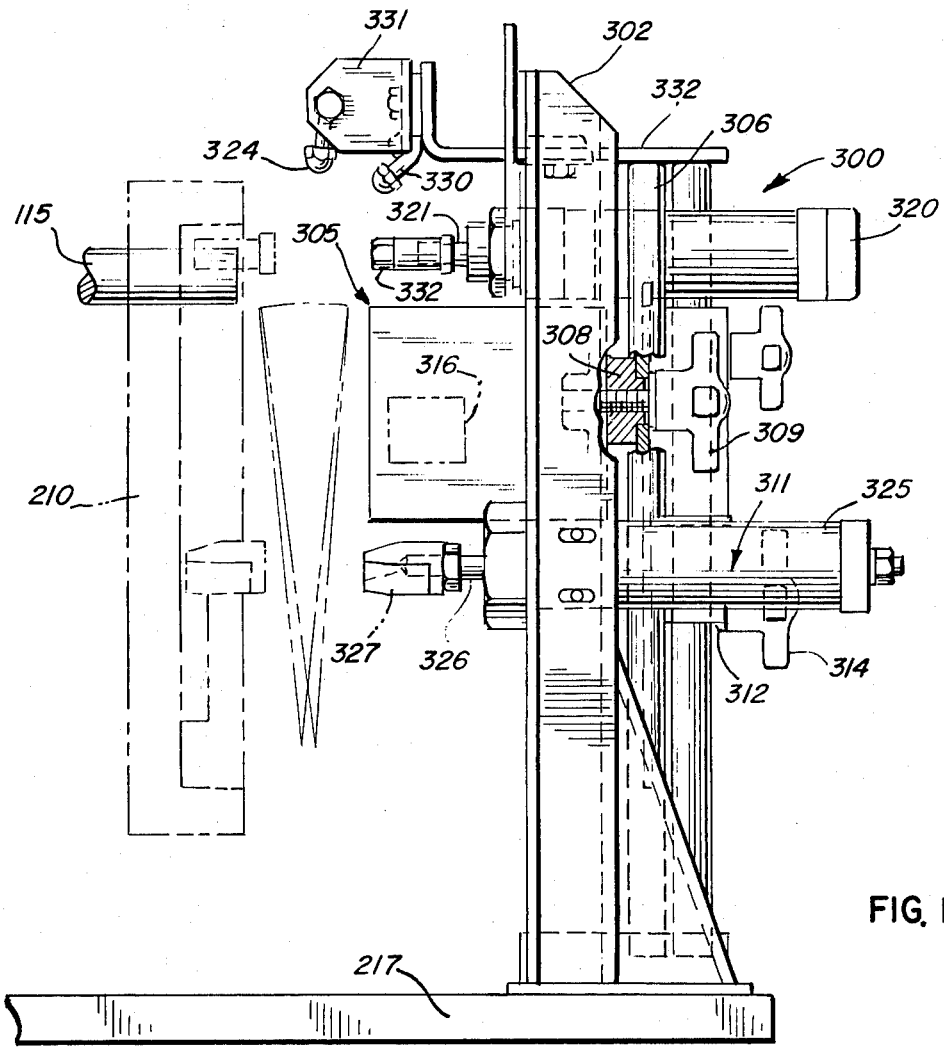
FIG. 14

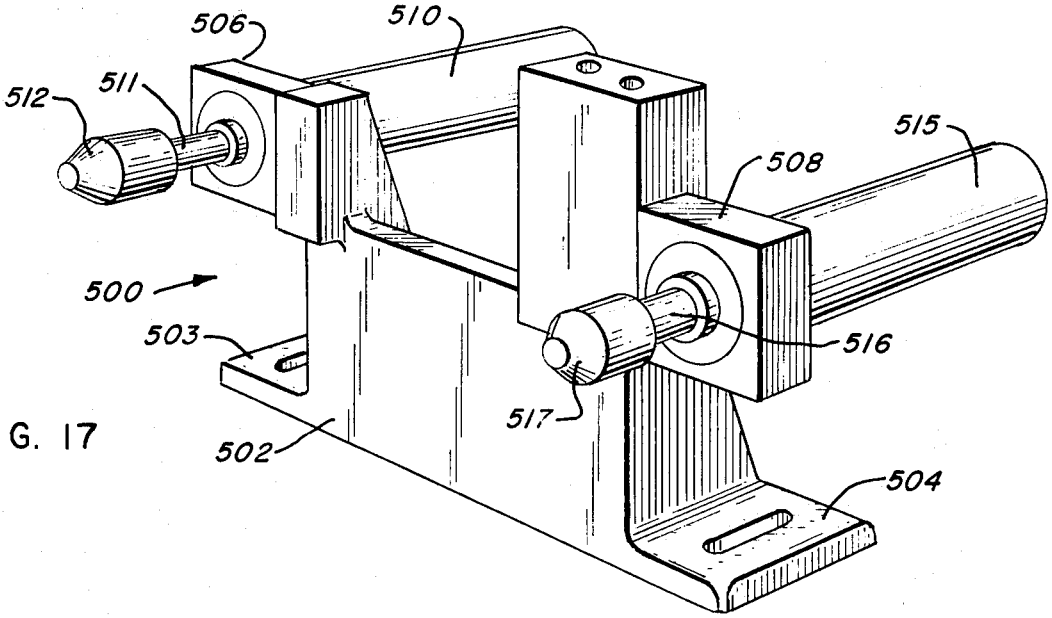
FIG. 17
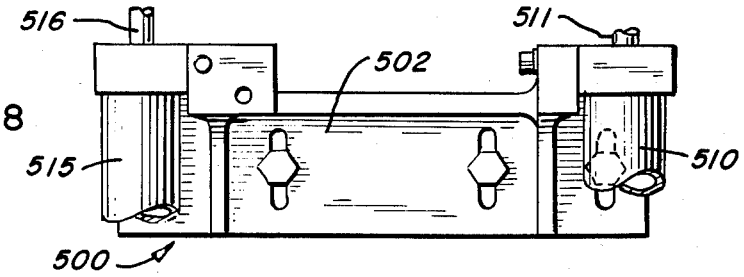
FIG. 18
FIG. 19
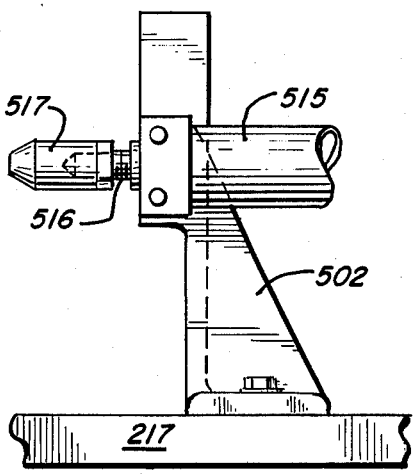
FIG. 20
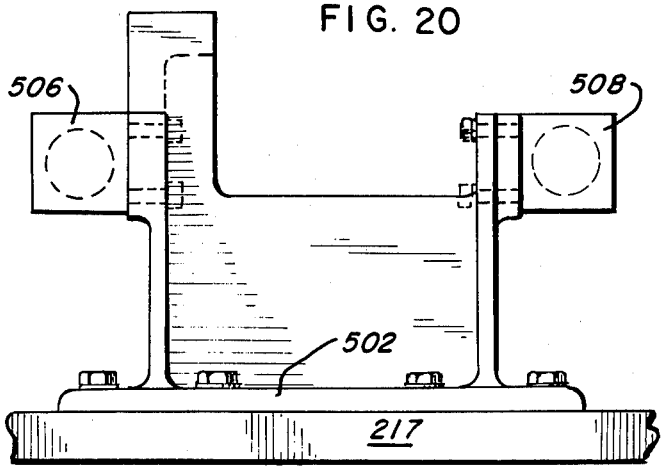

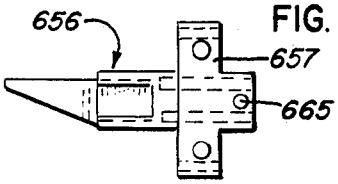
FIG. 25
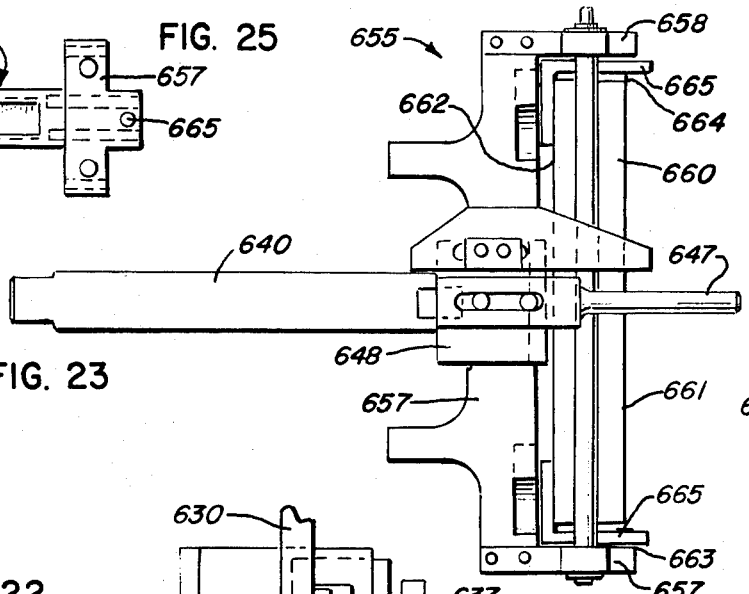
FIG. 23
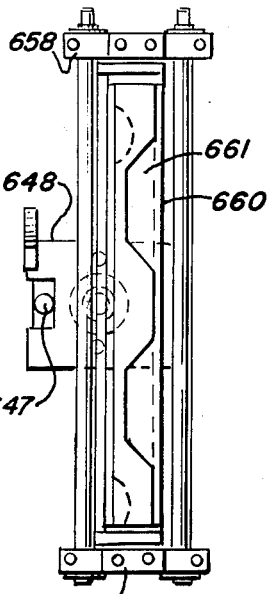
FIG. 24
FIG. 22
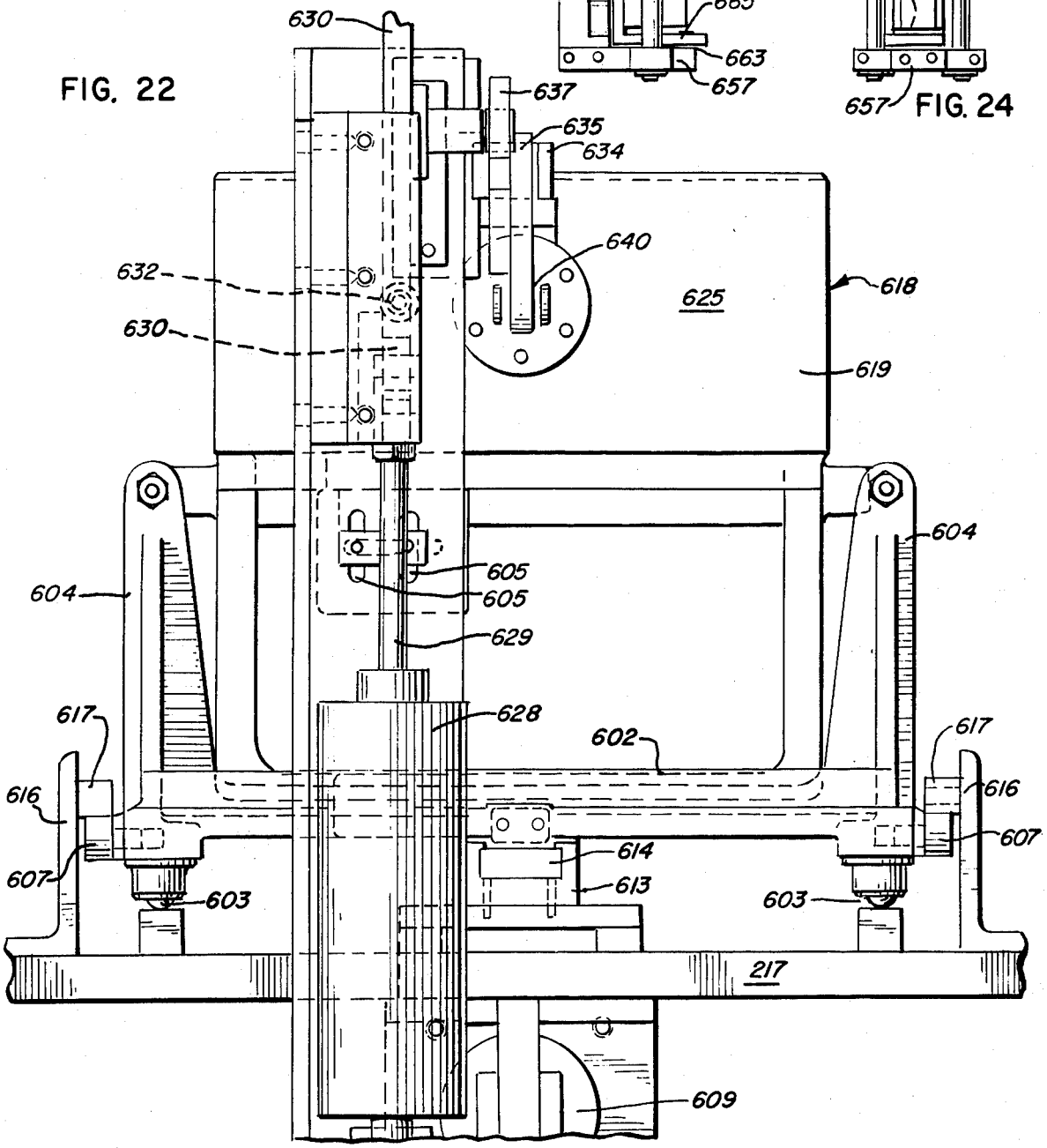

PACKAGING MACHINE

BACKGROUND OF THE INVENTION

The field of the present invention relates to an improved automated vacuum food packaging machine which seeks to accomplish the processing steps of loading an empty food package onto a processing turret, and subsequently performing all related processing steps including the steps of imprinting the package, loading the package with the designated food product, insuring against further processing of any unfilled or improperly filled food package, drawing vacuum, injecting nitrogen and sealing the food package while under vacuum conditions to insure the purging of all air, and effecting the discharge of the package from the turret for further handling.

It will be appreciated that a variety of packaging machines are currently available with a view toward automating the package of designated food products in a plasticized food container. It has been found that food products such as meat loaves or cheese products sold as individual slices may be conveniently packaged in plasticized food pouches such as polyethylene pouches, and it has been desirable to develop machinery which will automatically handle the package thereby to minimize manual handling and resulting purification problems associated therewith.

While the present invention has specific reference to sliced meat products as the food product to be packaged in individual polyethylene pouches, nevertheless, the machine forming the subject matter of the present invention similarly has application to other food products which are intended to be individually packaged in separate containers. By way of background, food products such as meat slices or cheese slices have conveniently been packaged on flat packs formed by a flat cardboard or hard paper backboard, wherein the meat or cheese is deposited on the backboard, and the packaging machine operating to bubble pack the top portion of the packet to effect a food package suitable for sale on a mass production basis. While machines of this type have found a high degree of success, nevertheless, it has been found that purification problems have resulted with the oxygen content of the food package, which has an effect on bacterial growth and, hence, has an impact on the shelf life of the product. In addition, such packaging systems generally are constructed along a horizontal or linear pathway, with each processing station being positioned along the linear path of travel of the food package. Hence, such packaging systems generally consume a significant amount of manufacturing space, and further require the attendance of a number of workers along the linear path of the manufacturing line in order to perform various processing functions. For example, the packaging system which involves the deposition of meat or cheese slices onto a plasticized or cardboard backboard which is then bubble-packed generally is laid out along a linear pathway wherein the food package enters the line at one end, and is processed sequentially along the linear pathway of the assembly line until a completed package is discharged from the line at the other end, the package then being self-contained, purified, sealed and discharged. In addition, the sealing operation is generally accomplished on a manual basis in that it is necessary to have an operator take each individual package, insert the same on a back support, and then activate a vacuum hood which surrounds the package, gases the same, heat seals the same, and then either ejects the package from the vacuum hood or requires the operator to remove the package therefrom.

With specific reference to the vacuum hood assemblies currently available, in most instances, a vacuum hood is provided which is pivotally mounted on a support or frame, and wherein the frame or support further incorporates the gas nozzle provided to purify the product, and also supporting the heat sealing means for heat sealing the plastic covering for the food package. In most of such packaging systems, the vacuum hood is actuated to surround the support containing the food package, a vacuum is then drawn, and the table or frame which supports the food package and the vacuum hood also supports the gas nozzles for purifying the product, as well as the heat sealing bars, which are actuated to purify and heat seal after the vacuum has been established. It has been found that in such systems, an imperfectly seated vacuum hood will affect the air content of the resulting package, and if the air content is in excess of 1.5% by volume, bacterial growth is precipitated and shelf life is affected. In addition, it has been found that if the heat sealing bar does not make proper contact with the package, and the heat seal is imperfect, once again, the air content of the resulting food package will increase with time thereby resulting in a loss of shelf life of the resulting food package.

The packaging machine of the present invention is intended to accomplish various improvements, including a minimizing of manufacturing space since the machine is designed in a compact form, the reduction of labor associated with the operation of the machine since only one operator is all that is necessary to oversee the operation of one or more of the novel machines, and further, improvements have been effected to the vacuum hood assembly and the heat sealing bar assembly.

With reference to the prior patented art, various forms of improvements in packaging systems and devices of the type referred to hereinabove have had varying degrees of success. For example, in U.S. Pat. No. 3,910,009, there is shown an improved packaging machine, wherein the improvement resides in the provision of an improved vacuum station such that packages which are filled but unsealed may be loaded into a vacuum chamber to purge virtually all of the oxygen from the package, and while under the purged condition, the pouches or food packages are sealed and then automatically removed from the vacuum chamber and unloaded from the holders associated with the vacuum chamber. It will be appreciated, however, that the above-noted device merely forms one station along a linear manufacturing line, and is not part and parcel of a compact packaging machine designed to automatically accomplish all packaging functions virtually on a sequential basis. Hence, while an improved vacuum system may be disclosed, the vacuum system is not within the framework of a single machine.

Similar comments are applicable with regard to another form of a vacuum packaging apparatus disclosed in U.S. Pat. No. 3,780,489. In the invention disclosed therein, an apparatus is provided for vacuum packaging articles in flexible pouches or bags wherein the apparatus is provided with a plurality of vacuumizing nozzles and pouch sealing means. Once again, it will be observed that the invention provided in the aforementioned patent simply provides an improved vacuum station, in effect, for a package formed by a flexible bag having a product packaged therein. Once again, the invention does not form a part of a synchronized packaging machine, but rather, forms a separate station which would be positioned along the linear path of a complete manufacturing line.

Even more exemplary of the prior art type machines is U.S. Pat. No. 3,619,975 which is directed to an improved packaging machine for packaging products in a flexible wall pouch in the presence of an inert gas, and has for its object the provision of a machine which will open flat pouches, fill the same, seal the pouch in a controlled atmosphere, and advance the same to a discharge station where the pouches are released. It will be observed, however, that the improved machine contemplates a system wherein the pouches are advanced edgewise along a predetermined horizontal path and wherein the processing stations are located along the horizontal path for operating or processing the pouches. It will further be noted that the machine provided for in the U.S. Pat. No. 3,619,975 does not perform an individual bag loading function, imprinting function, food loading function, purification and sealing function, and to thereafter discharge the food package as a completed unit. In short, the device shown in the U.S. Pat. No. 3,619,975 actually relates to a machine forming a part of a manufacturing line which, in turn, consists of a number of such machines constructed to accomplish the above-noted functions.

Various other similar type packaging machines attempting to accomplish the above-noted functions are shown in the prior patented art, such as for example, U.S. Pat. No. 3,478,492 which discloses a packaging machine including a filling station, a loading station, and sealing and trimming stations, respectively. It will be noted, however, that generally, machines of the type shown in the U.S. Pat. No. 3,478,492 relate to machines of the type seeking to fill a food container with particulate matter and, therefore, do not reach the problem of inserting bulky foodstuffs into a flexible food bag. Similarly, U.S. Pat. No. 3,094,825 shows a food packaging machine for packaging irregularly sized foodstuffs such as meat products; however, it will be observed that even with the automated machinery so described in the aforementioned patent, a significant amount of handling is still required. For example, it will be noted that in order to accomplish the positioning of the package in the vacuum box, an operator is required to grasp the open end of the bag which is under the nozzle, and guide or position the bag end around the nozzle in order to insure that the proper vacuum is obtained in the food package.

Similar problems are evident with regard to the remaining prior art considered to be relevant with regard to the subject matter described herein.

OBJECTS AND ADVANTAGES

It is, therefore, deemed to be the principal object of the invention to provide an improved packaging machine which is compact in size and which, nevertheless, performs a complete series of processing functions with regard to a food package, including the function of loading a single container into the machine for further processing, and sequentially imprinting, filling, purifying, sealing, and discharging a completed food package therefrom.

In connection with the foregoing object, it is a principal object of the invention to provide a multi-station packaging device for automatically packing a portion of a food product into a food container and performing all subsequent packaging operations which is formed by a support table, a turret mounted on a support table, the turret including a plurality of food container retention means, each of which is designed to retain a single food container thereon, at least a first processing station for arresting and depositing a single food container on the turret, at least a second processing station for loading a pre-determined portion of the food product into the food container, at least a third processing station for creating a vacuum environment surrounding the filled food container, and further including purification means and sealing means for purifying and sealing the food container, and a discharge means for discharging the processed food package therefrom, and indexing means associated with the turret and processing stations thereby to effect an indexing function in order to subject the food package to each of the aforementioned processing functions.

In connection with the foregoing object, it is yet a further object of the invention to provide a packaging machine of the type described wherein a total of six processing stations are provided in circumferentially spaced and sequentially arranged order with regard to a rotatable turret, the rotatable turret adapted and constructed to contain the food package to be processed, and each of the individual six processing stations performing a subsequently timed processing function whereby a food package may be inserted on the turret, imprinted with predetermined indicia, filled with a predetermined food product, detected for proper positioning and filling, purged under vacuum conditions, heat sealed, and discharged from the turret for further handling.

A further object of the invention is to provide an improved packaging machine which provides an improved vacuum hood assembly wherein the vacuum hood is mounted on and carried by a self-positioning carriage in order to effect uniform seatment of the vacuum hood against the turret containing the food package to be processed, and wherein the vacuum hood further carries with it the purification means as well as the heat sealing means such that purification and heat sealing will occur only after a leak proof vacuum environment has been created surrounding the food package.

In connection with the foregoing object, it is still a further object of the invention to provide an improved packaging machine wherein an improved heat sealing bar assembly has been provided, the heat sealing bar being pivotally mounted from a support yoke adjacent the top end thereof such that the arc of travel of the heat sealing bar is reduced, substantially, in order to insure that the maximum amount of heat sealing capacity is transferred to the food package thereby insuring a complete and leak-proof seal.

Further features of the invention pertain to the particular arrangement of the elements and parts whereby the above-outlined and additional operating features thereof are attained.

The invention, both as to its organization and mode of operation, will best be understood by reference to the accompanying drawings and following specification as described hereinafter.

BRIEF DESCRIPTION OF DRAWINGS

FIG. 1 is a perspective view of a schematic representation of the hexagonal turret forming a portion of the present invention;

FIG. 2 is a side elevational view, partly in phantom, illustrating one of the turret faces and back-up plate assemblies turret;

FIG. 3 is a front elevational view showing the details of construction of the turret face and back-up plate assembly and associated pouch retention means forming a part thereof;

FIG. 4 is a top view showing the relationship between the pair of jaw arms carrying the pouch retaining jaw clamps thereon;

FIG. 5 is an enlarged view partly in cross section, showing the rack and pinion arrangement incident to the reciprocating means for the upper portion of the backup plate;

FIG. 6 is a side elevational view, partly in cross section, showing the details of construction of the back-up plate and the reciprocating means associated therewith;

FIG. 9 is a top plane view showing the adjustment means associated with the magazine hopper indicating the manner in which the hopper may be adjusted to insure proper placement of the food pouch on the turret face;

FIG. 10 is a side elevational view, again showing details of the adjustment feature of the magazine hopper;

FIG. 13 is a top view, partly in phantom, showing the details of the pouch opening assembly associated with the imprinting station;

FIG. 14 is a side elevational view, partly in cross section and in phantom, again showing the details of the imprinting station as well as the pouch opening assembly associated therewith.

FIG. 17 is a perspective view showing the ejection rams associated with the fourth processing station actuating the jaw clamps to open and discharge an improperly opened pouch;

FIG. 18 is a top view showing the ejection ram associated with Station 4;

FIG. 19 is a side elevational view showing the positioning of the ejection rams of Station 4;

FIG. 20 is a rear elevational view of the subject ejection rams of Station 4;

FIG. 22 is a rear elevational view, partly in cross section, showing the details of the vacuum hood assembly;

FIG. 23 is a top plane view showing the details of the heat sealing bar assembly and supporting yoke;

FIG. 24 is a top plane view, partly in cross section, showing the manner of the pivotal connection of the heat sealing bar to the supporting yoke;

FIG. 25 is a side elevational view, partly in cross section, of the yoke supporting the subject sealing bar and the mode of pivotal connection thereto;

GENERAL MODE OF ORGANIZATION

Figure 7:
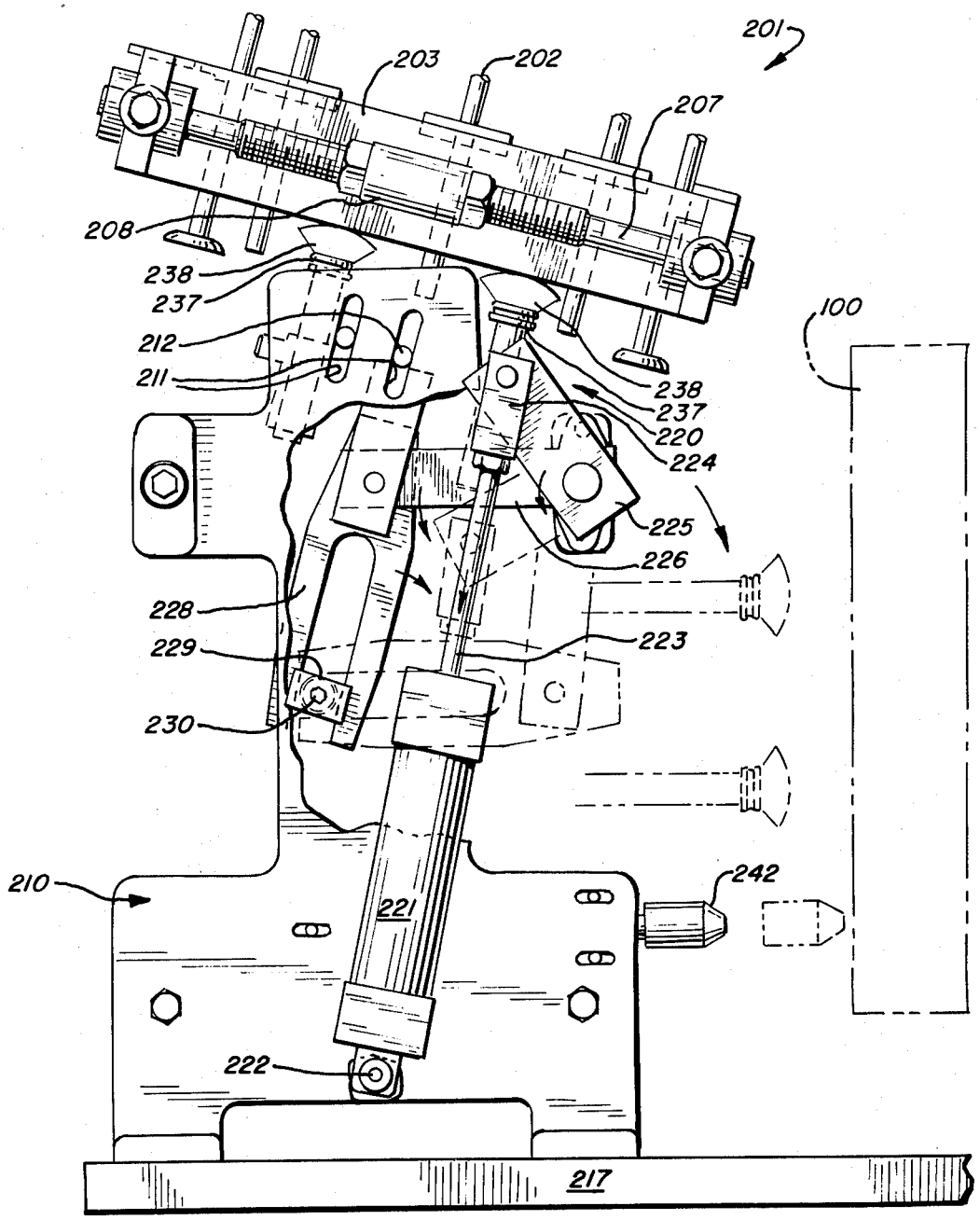
FIG. 7 is a side elevational view, partly in phantom, showing the details of construction of the magazine means and the deposition means whereby plasticized food pouches may be retrieved from the magazine and deposited on the turret face assembly.

As has been indicated hereinabove, the packaging machine of the present invention may generally be described in terms of a support table which carries a rotatable turret which is generally hexagonal in configuration. Each of the six sides of the turret is formed of a turret face assembly on which is mounted a pivoted back-up plate reciprocable between a forward support position and rear rest position. The turret face assembly has a pair of pouch retention jaw clamps mounted on a pair of jaw arms which are constructed to grasp the side edges of a plasticized food pouch positioned thereon. The first processing station is generally adapted to retrieve a single plasticized food pouch from a magazine hopper containing a plurality of such pouches and to insert one of the plasticized food pouches onto the turret by inserting the food pouch into the jaw clamps carried by the jaw arms of a turret face. The pouch deposition means of the first processing station will operate in conjunction with the indexing means, to be described hereinafter, to deposit an individual food pouch on each of the turret face assemblies of each of the six sides of the turret as the turret is caused to rotate sequentially.

Once an individual food pouch has been inserted into the jaw clamps carried by the jaw arms of a turret face assembly and the turret is caused to rotate to the next adjacent processing station, the second processing station will operate to imprint the pouch with pre-determined indicia in a manner to be described hereinafter, and subsequently the jaw arms are caused to move toward one another for a short distance to permit sufficient slack in the pouch so that the pouch may be properly opened. Once the jaw arms have moved together, a pair of air nozzles operate, a first nozzle putting a light jet of air against the extended lip of the back of the pouch to commence the opening operation, and the second air nozzle blowing directly into the pouch thereby to open the pouch to its substantial dimension.

Once the food pouch has been properly opened to its substantial dimension, and in sequential response to completion of the processing accomplished at the second processing station, the turret will automatically rotate to move the turret face assembly holding the opened food pouch to the third processing station which comprises the pouch detection and meat loading operation.

The third processing station further includes means for determining whether or not a pouch has been properly opened and is prepared to receive the food product therein. The detection is accomplished by a pair of photoelectric beams which are interrupted by the properly opened pouch. Should the pouch not be properly opened, the beams are undisturbed and a signal is then fed into a fourth processing station memory bank which will operate to eject the bag from the turret face assembly, and simultaneously, the signal prevents any meat loading at the third processing station.

Immediately above the subject packaging machine is a food conveyor which carries a pre-cut stack of meat or other food product to a loading chute, the meat dropping from the conveyor into the loading chute. The meat product will then travel from the loading chute into a pair of scoop arms which are positioned immediately below the loading chute and function to receive the meat from the loading chute in preparation for insertion into the food pouch. Once the meat has been received by the scoop arms, the third processing station is actuated to operate causing a reciprocation of the scoop arms downwardly into the opened food pouch which is carried on the corresponding turret fact assembly of the turret. Once the scoop arms have been inserted into the pouch carrying the meat therein, a loading ram mechanism is actuated to reciprocate forward and position a loading ram above the scoop arm and reciprocate further downwardly to positively insert the food product from the scoop arms into the open food pouch. Upon completion of the cycle, the ram once again reciprocates upwardly with the scoop arms following to return to their upward position actuating the indexing means to again rotate the turret head to the next adjacent processing station.

The fourth processing station includes ejection means to eject the pouch should it not be properly opened as determined in the third processing station. As indicated previously, the fourth station is provided with a memory bank so that a signal received from the third processing station indicating the presence of an improperly opened food pouch on the turret is stored until the improperly opened pouch arrives at the fourth station. At that point, the ejection means of the fourth processing station are actuated to open the respective jaw arms and discharge the pouch therefrom. Once the processing function has occurred at the fourth processing station, the turret will then rotate in response to the indexing means to the fifth processing station.

In any event, assuming that a food pouch has been properly filled, the indexing means will operate to rotate the turret and corresponding turret face assembly having the filled food pouch thereon to the fifth processing station. The fifth processing station includes a vacuum hood carried by a self-positioning carriage which is actuated to reciprocate forwardly and insert the vacuum hood into surrounding relationship with respect to the corresponding turret face assembly. The self-adjusting features of the carriage and vacuum hood are arranged such that a leak proof seal is established to create a leak proof environment. If it has been properly positioned, a vacuum is drawn surrounding the food package having the meat product contained therein, after which a nitrogen nozzle is actuated to purge all of the remaining air from the food pouch and meat contained therein after which the heat sealing bar assembly is actuated to reciprocate forwardly pressing the heat sealing bar against the upper lateral extant of the food pouch. As the heat sealing bar moves forward to seal the upper portion of the pouch, simultaneously, the back-up plate assembly is caused to move forward into a forward support position immediately behind the pouch such that at the point that the heat sealing bar presses against the upper portion of the pouch, the back-up plate will act as a support surface against which the sealing operation will be effective. In this posture, the pouch is held firmly clamped between the sealing bar and the back-up plate effectively sealing the same. Upon completion of the heat sealing operation, the heat sealing bar and back-up plate assemblies again reciprocate into their retracted positions, air is returned to the vacuum chamber releasing the vacuum, and the vacuum hood reciprocates away from the turret face. The indexing means will then cause the turret to rotate, sequentially to the final processing station.

The sixth and final processing station comprises a discharge station which includes two discharge rams which are actuated to move forwardly to open the jaw clamps discharging the filled bag and a jaw arm cocking ram to cock the jaw arms by bringing the jaw arms together in preparation for receiving another empty food bag to repeat the processing cycle.

DETAILED DESCRIPTION OF TURRET ASSEMBLY

With reference to FIGS. 1 through 6 of the drawings, the turret, generally referred to by the numeral 100, is illustrated. As shown in FIG. 1, the turret 100 is formed by a turret having a hexagonal head 101 supported on a support base 104. Each of the hexagonal heads 101 is provided with a turret face and backup plate assembly 103, the details of construction of which are shown in FIGS. 2 through 6 of the drawings.

Each turret face and back-up plate assembly 103 is shown to be supported on a support base 104 which carries an upstanding support 105 thereon. Adjacent the rear portion of each turret face 102 is the point of interconnection of each of the turret face 102 and back-up plate assemblies 103 with the support base 104, which in turn is interconnected to the indexing assembly 106. The interconnection is achieved by means of a stanchion 107 which interconnects with an indexing support 108. As indicated previously, the indexing function operates to rotate the entire hexagonal head 101 of the turret 100 thereby to move a food package to each of the individual processing stations in the manner generally described hereinabove. The indexing function is not considered to be critical to the invention disclosed herein since any number of indexing means may be employed to accomplish the necessary indexing function. It will be appreciated that one skilled in the art can provide an indexing assembly such as the type referred to by the numeral 106 which can be appropriately interconnected with the processing stations of the present invention to accomplish the stated function.

Each of the turret face and back-up plate assemblies 103 is shown to be formed by a back-up plate 110 which is pivotally mounted to the upstanding support 105 in the manner shown especially in FIG. 6 of the drawings. There is provided a first pivot point 111 adjacent the lower portion of the back-up plate 110 whereby the lower portion is pivotally secured to the upstanding support 105. The upper portion of the back-up plate 110 is shown to be pivotally mounted to a lower rack 112 at a second pivot point 113 by means of a pivot slide 114. Spaced upwardly from the lower rack 112 in an upper rack 115, the lower rack 112 being carried in a lower rack guide 116, while the upper rack 115 is carried in an upper rack guide 117. The lower rack guide 116 and upper rack guide 117 are enclosed by caps 119 and 118, respectively. Interposed between the upper rack 115 and lower rack 112 is a spur gear 120 which is rotationally mounted between the racks 112 and 115. In addition, the upper rack 115 is spring-loaded by means of a compression spring 122, the upper rack 115 extending forwardly beyond the front surface of the upstanding support 105 forming a strike head 123. It will therefore be appreciated that the movement of the lower rack 112 is caused by striking against the strike head 123 to reciprocate the upper rack 115 against the biasing effect of the compression spring 122 causing the spur gear 120 to rotate and hence moving the lower rack 112 outwardly which, in turn, pivots the upper portion of the back-up plate 110 forwardly into a support position. This function will be described in greater detail hereinafter in connection with various stations of the machine.

With reference to FIGS. 2 and 3 of the drawings, the details of construction of the turret face and back-up plate assembly 103 are shown. The turret face 102 is provided with a pair of support arms 124 and 125 respectively. These are "L" shaped and when put together, form a U-shaped assembly interconnected by a spring button 126 adjacent the lower ends thereof. The jaw arm 124 is provided with a spring retention ear 127 which functions for a purpose to be described hereinafter. The upstanding support 105 includes a spring mount 128 which extends forwardly from the surface thereof, and a tension spring 130 is carried between the spring retention ear 127 and spring mount 128. Due to the construction of the jaw arms 124 and 125 and the manner of interconnection by means of the spring button 126, the tension spring 130 tends to pull upwardly on the spring retention ear 127 of spring button 126 thereby normally tending to cause the arms 124 and 125 to be extended to their farthest lateral position. An arm stop 131 connected to jaw arm 124, is provided which includes two detents forming two stop positions for the jaw arms 124 and 125 such that the jaw arms 124 and 125 may be cocked in two lateral positions different from a fully open or spread apart position.

The upper positions of the jaw arms of 124 and 125 carry the rear portions of the jaw teeth 132 and 133, respectively, each of which mates with front jaws 134 and 135. The front jaws 134 and 135 are each carried by jaw levers 136 which extend along the jaw arms 124 and 125. The jaw levers 136 are pivotally mounted to the jaw arms 124 and 125 at the approximate mid-vertical position thereof, and are constructed to be movable in response to a pair of strike rollers 138. The rear jaws 132 and 133 and front jaws 134 and 135 are normally held together by the interaction of compression springs 122 secured between jaw arms 124 and 125 and jaw levers 136 respectively. Hence, when the strike rollers 138 are struck by a ram (to be described hereinafter), the jaw levers 136 pivot along the central portion thereof such that the upper front jaws 134 and 135 move away from the corresponding rear jaws 132 and 133 thereby to open the jaw members on both sides of the back-up plate 110. The synchronization of the jaw pairs 132–134 and 133–135 is accomplished via mechanical linkages.

The jaw arms 124 and 125 may be cocked into the two cocking positions by two different assemblies. With reference to FIG. 3 of the drawings, there will be observed a pivotally secured pawl assembly generally referred to by the numeral 140. The pawl assembly 140 includes a pawl 141 which is pivotally mounted to a pawl bracket 142 by means of a pin 143 as shown in FIGS. 2 and 3 of the drawings, the pawl 141 being maintained in its extended position by pawl spring 145. The lower end of the pawl 141 restricts the lateral movement of the jaw arm 124, which in turn through the linkage at 126, restricts the lateral movement of jaw arm 125. It will be appreciated that when the pawl 141 is struck by a ram (to be described hereinafter) adjacent the top end thereof, the pawl 141 will pivot on the pivot pin 143 causing the lower portion of the pawl 141 to move forwardly and out of contact with arm stop 131. Due to the biasing force exerted by the spring 130, the jaw arms 124 and 125 will tend to cock laterally outwardly away from each other to a distance governed by the detents in the arm stop 131.

Spaced below the pawl assembly 140 is an additional cocking roller 146 which, again, interconnects with the jaw arm 124 through a rotational linkage thereby to cause the cocking of the jaw arms 124 and 125 when the cocking roller 146 is struck by a corresponding ram causing the arms 124 and 125 to cock to their cocking positions. The various rams referred to hereinabove will be described in detail in connection with others of the processing stations set forth hereinbelow.

It will be appreciated from the above description that three reciprocating functions must be achieved in the turret face and back-up plate assembly 103 in order for the proper functioning of the turret 100. These three functions include the reciprocation of the upper portion of the back-up plate 110 by striking the strike head 123 of the upper rack 115 to cause the pivotal movement of the back-up plate 110 forwardly into a support position in order to accomplish the printing and sealing operations; the cocking of the jaw arms 124 and 125 into two different laterally extended positions in order to extend the food pouch held in the pairs of jaw teeth 132–134 and 133–135, the lateral extent of the cocking being dependent upon the processing station involved; and the reciprocating movement to cause the pairs of jaw teeth 132–134 and 133–135 to open and close in order to alternately retain a pouch therebetween and to discharge a pouch therefrom upon completion of the processing cycles.

DETAILED DESCRIPTION OF POUCH MAGAZINE AND DEPOSITION HEAD

The first processing station associated with the subject packaging machine includes a magazine 201 which is adapted to contain a plurality of food pouches stacked in vertical orientation. The details of construction of the pouch magazine 201 and the adjustment features thereof are more particularly demonstrated in FIGS. 9 and 10 of the drawings. It will be observed that the pouches are retained in a substantially vertically stacked orientation by pouch guides 202 which maintain the food pouches in a neat and stacked condition. The magazine 201 is shown to be formed by a substantially rectangular frame 203 which is carried on a pair of support rails 204 and 205, respectively. As shown in FIG. 10, the support rails 204 and 205 carry a pair of slides 206 through which threaded shafts 207 extend. From a view of FIGS. 9 and 10 of the drawings, it will be appreciated that the frame 203 may be moved relative to the rails 204 and 205, respectively, thereby to effect a side-to-side adjustment of the magazine 201 with respect to the turret face 102. As shown in FIG. 7, there is also provided a frame support 208 which supports the magazine 201 on the station frame 210. The frame support 208 carries a pair of slides 211 through which a pair of clamping screws 212 are mounted for accomplishing the up and down adjustment feature. It will also be observed (FIG. 9) that seven of the pouch guides 202 are carried by adjustment plates 214 which permit the horizontal adjustability of each of the pouch guides 202. In addition, one pouch guide 202 is carried by an adjustment bar 215 which permits vertical adjustment of the pouch guide 202 to compensate for pouch warpage. The adjustment bar 215 is adjustable in a plane perpendicular to the plane of the support rail 204. It will, therefore, be appreciated that the magazine 201 carried by the station frame 210 is completely adjustable in order to permit the stacks of pouches carried therein to be physically adjusted such that upon reciprocation of the deposition means described hereinafter, a food pouch will be properly positioned on the turret face 102 of the turret 100.

Figure 8:
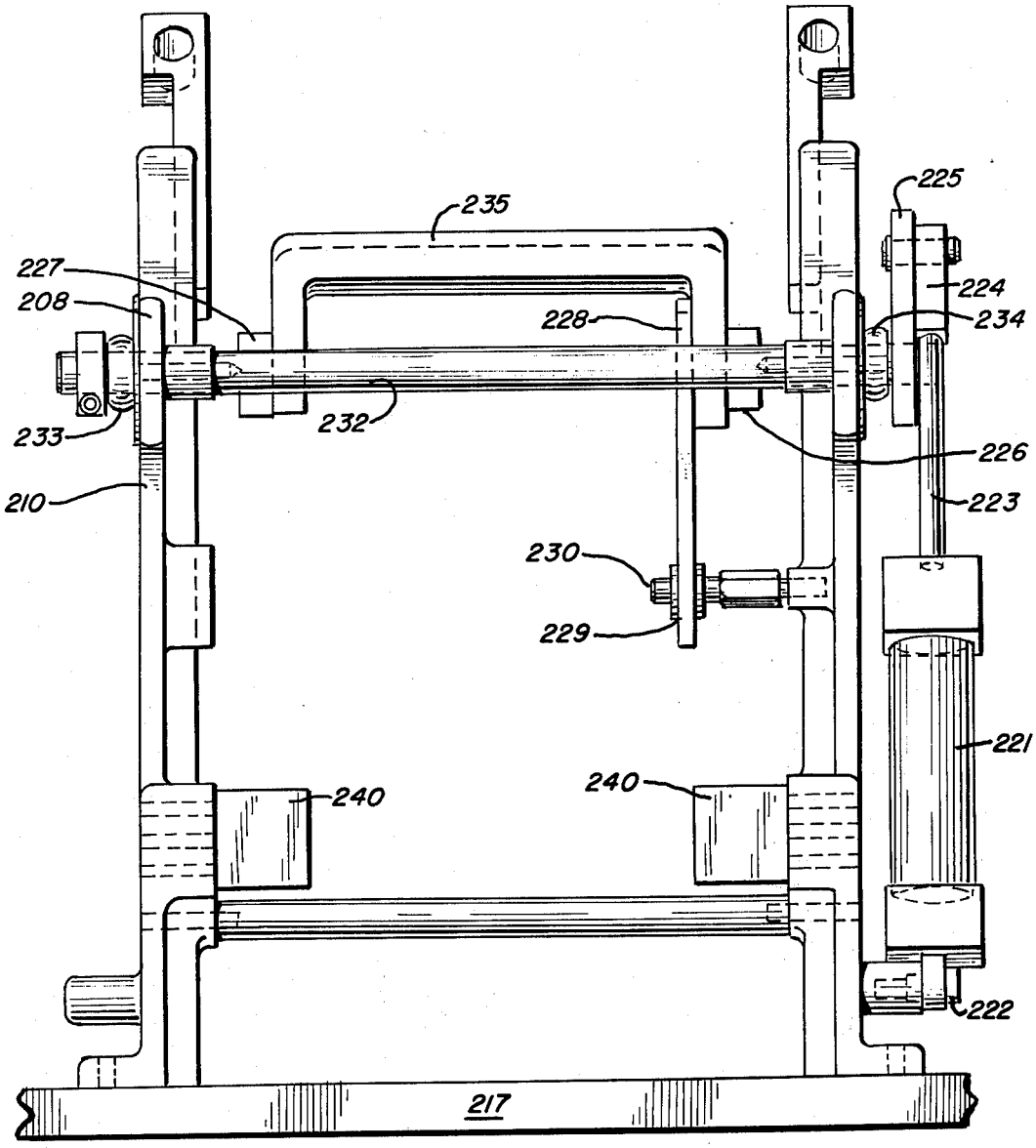
FIG. 8 is a back elevational view showing the supporting structure for the deposition means for accomplishing the pouch retrieval and depositing function associated with the first processing station.
Figure 11:
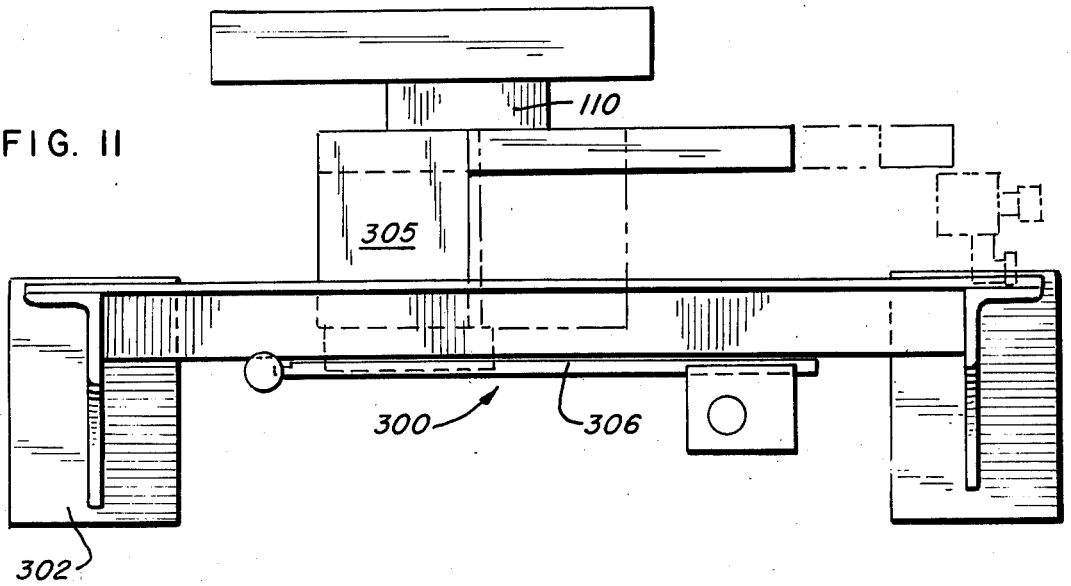
FIG. 11 is a top view, partly schematic, showing the overall organization of the imprinting station.

With reference to FIGS. 7 and 8 of the drawings, the details of construction of the deposition head and supporting frame are illustrated. The station frame 210 is mounted upon a support table 217, such that the processing station is fixedly secured to the underlying support table 217. The station frame 210 carries a reciprocating deposition head generally referred to by the numeral 220.

With specific reference to FIG. 8, it will be observed that the station frame 210 carries a pivot cylinder 221 which is pivotally mounted on the frame at a pivot point 222. The pivot cylinder 221 includes a cylinder rod 223 which is mounted to a cylinder rod eye 224 which, in turn, is pivotally secured to a pivot lever 225. The pivot lever 225 is mounted to two pivot support arms 226 and 227 which, in turn, are secured to a pivot shaft 232.

Pivot support arms 226 and 227 ride in a pair of bearings 233 and 234 respectively. The pivot shaft 232 carries a bridge carriage 235 which will rotate in response to the rotational movement of the pivot shaft 232 and pivot support arms 226 and 227. It will also be observed that there is provided a track pivot plate 228 which is secured to the bridge carriage 235, which is formed with a track slide 229 (FIG. 7) which track pin 230 therein. The bridge carriage 235 carries a series of 3 vacuum cup holders 237 which will pivot and reciprocate in response to the movement of the bridge carriage 235. The vacuum cup holders 237 are, of course, connected to vacuum forming means (not shown) such that a vacuum may be established in the vacuum cup holders 237. The vacuum cup holders 237 are each provided with flexible suction cups 238 at the top ends thereof, the vacuum cup holders 237 having the suction cups 238 mounted thereon serving as the pouch retrieving device and depositing mechanism. As shown in FIG. 7 of the drawings, the deposition head 220 functions by actuating the pivot cylinder 221 to extend the cylinder rod 223 upwardly moving the bridge carriage 235 upwardly and hence, moving the vacuum cup holders 237 and suction cups 238 into touching contact with the lower-most food pouch contained in the magazine 201. A vacuum is then established such that the lowermost pouch will adhere to the suction cups 238, after which, the entire reciprocating deposition head moves downwardly in response to the downward movement of the cylinder rod 223, and pivots toward the turret 100.

The pivoting and reciprocating action is accomplished by the interconnection of the cylinder rod eye 224 with the pivot lever 225 and in turn with the interconnection to the pivot support arms 226 and 227, and track pivot plate 228. As shown in FIG. 7, as the cylinder rod eye 224 reacts downwardly, this pulls the pivot lever 225 downwardly which, in turn, retracts the pivot support arms 226 and 227 downwardly. This action, in turn, pivots the track pivot plate 228 downwardly, the aforementioned structure operating as a bell crank thereby to not only retract the reciprocating deposition head 220 downwardly, but also to pivot the same in the direction of the the back-up plate 110 of the turret 100. The respective arcs of travel of the elements referred to above is illustrated in FIG. 7 of the drawings of the arrows. As indicated previously, the proper positioning of the food pouch onto the turret face 102 of the turret 100 is, to some extent, controlled by the proper adjustment of the magazine 201 by the use of the various adjustment mechanisms described above.

In order to accomplish the deposition of the food pouch onto the turret face and back-up plate assembly 103 of the turret 100, it will be observed that a pair of jaw actuating cylinders 240 (FIG. 8) are provided. Each of the cylinders 240 includes a jaw actuating rod end 242 (FIG. 7) which when actuated, will move forward toward the turret face 102 and come into striking contact with the strike rollers 138. As contact occurs, the srike rollers 138 will cause a pivoting of the respective jaw levers 136 which in turn carry the front jaws 134 and 135, thereby to open the pairs of jaws of 132–134 and 133–135. As the cylinder rod ends 242 are retracted, the reverse pivoting of the jaw levers 136 is achieved thereby closing the respective pairs of jaw members 132–134 and 133–135 grasping the side edges of a food pouch which is now retained upon the turret face and back-up plate assembly 103.

The operation of the pouch magazine and deposition head is controlled by the indexing means of the machine via preestablished electrical circuitry which is in turn guided by the various mechanical movements incident to the indexing function. As indicated previously, the indexing function as well as the electrical circuitry associated therewith are deemed to be well within the knowledge of the art.

It will, therefore, be appreciated that upon completion of the cycle of the first processing station, a single food pouch has been retrieved from the pouch magazine 201 and by means of the reciprocating deposition head 220, has been deposited on the turret face 102 of the turret 100 and held in position by the pairs of jaw members 132–134 and 133–135.

DETAILED DESCRIPTION OF IMPRINTING AND POUCH OPENING STATION

With specific reference to FIGS. 11 through 14 of the drawings, the pouch imprinting and pouch opening station is illustrated. The imprinting and pouch opening station 300 is shown to be supported on the support table 217 by means of a support frame 302. The support frame 302 is shown to be provided with at least a pair of frame uprights 303 which support the imprinting structure as well as the pouch opening structure.

Figure 12:
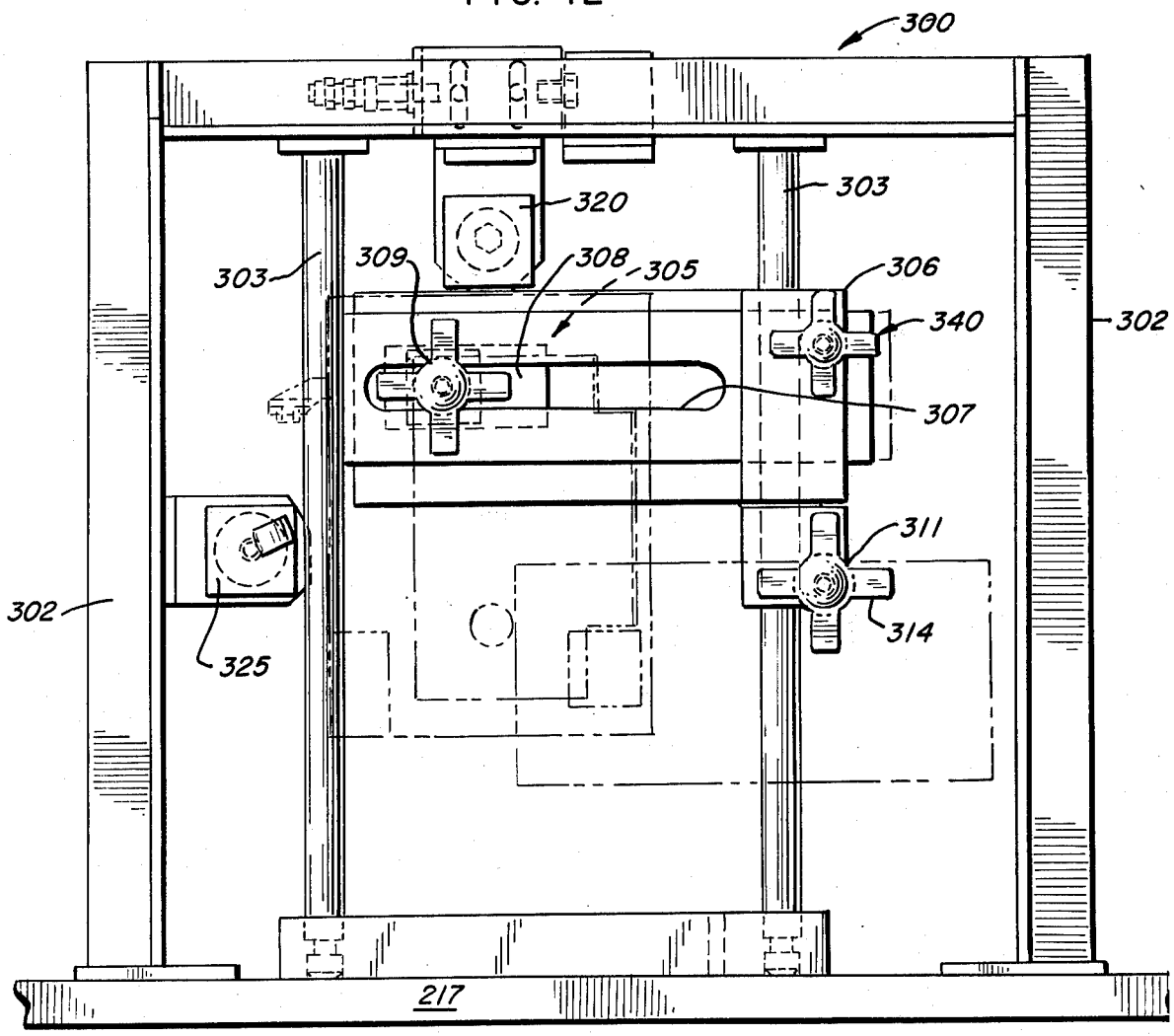
FIG. 12 is a front elevational view, partly in phantom, showing the details of the imprinting station.

With reference to the imprinting assembly, the entire imprinting assembly generally referred to by the numeral 305 is supported by a swing bar 306 which is in turn carried between the frame uprights 303. As shown in FIG. 12 of the drawings, the swing bar 306 is provided with an adjustment slot 307 in which an adjustment slide 308 is carried. Extending laterally outwardly from the adjustment slide 308 is a screw-threadedly mounted adjustment knob 309 which operates to secure the adjustment slide 308 at any desired point in the adjustment slot 307. This adjustment feature permits the horizontal adjustment of the imprinting assembly 305 where desirable or necessary in order to effect the centered printing of the pouch by the printing assembly 305.

In addition, the vertical adjustment of the imprinting assembly 305 is accomplished by means of a second adjustment assembly 311 which in effect is a collar 312 (FIG. 14) which rides on the frame upright 303. The collar 312 forms a support for the lower portion of the imprinting assembly 305 and is screw-threadedly tightened to the upright frame 303 by means of an adjustment screw 314.

The imprinting assembly 305 is formed by an imprinting plate 316, and is operated by an air cylinder (not shown). The air cylinder simply includes a cylinder rod which terminates at a rod end which, through a series of three pivotal connections with associated pivotal levers, forms a bell crank type arrangement such that the reciprocating movement of the cylinder rod within the air cylinder is transformed into a horizontally arcuate movement of the imprinting plate 316 thereby to swing the same into touching contact with the food pouch carried on the turret face 102. The structure and assembly associated with the pivotal connection of the imprinting plate 316 relative to the corresponding air cylinder is well known in the art and, in fact, is utilized on other similar types of packaging machines in order to accomplish the imprinting of the food container. The operation of the air cylinder controlling the imprinting assembly 305 is controlled by the indexing means which will be described hereinafter, and operates to actuate the cylinder and, therefore, the imprinting assembly 305 once a food pouch has been positioned on a turret face 102 of the turret 100, and moved into position in the imprinting station.

It will further be noted that the imprinting station 300 includes actuating means for insuring that the back-up plate 110 associated with the food pouch to be imprinted will be reciprocated into a forward support position. In this connection, there is provided an air cylinder 320 which carries a cylinder rod 321 therein and terminates in a rod end 322. At the point in time at which the imprinting assembly 305 is actuated, the cylinder 320 is similarly actuated thereby causing an extension of the cylinder rod 321 and rod end 322 in a forward direction. As shown in schematic in FIG. 14, as the rod end 322 extends forwardly, it will come into contact with the strike head 123 of the upper rack 115 forming a pant of the corresponding backup plate 110, which as indicated previously, through the action of the spur gear 120 will cause the forward movement of the lower rack 112 thereby pivotally reciprocating the upper portion of the back-up plate 110 into a forward support position behind the food pouch. In this posture, the pouch, properly supported, is ready for receiving the imprinting plate 316 in order to effect the imprinting thereof.

Once the station 300 has accomplished the imprinting function, the indexing means operates to cause the pouch opening function to occur. In this connection, there is provided a pouch opening air cylinder 325 which is similarly provided with a cylinder rod 326 terminating in a rod end 327. It will be observed that when the pouch opening cylinder 325 is actuated, the cylinder rod 326 and rod end 327 thereof will move forwardly until striking contact is made with the cocking roller 146 carried by the jaw arm 124. As the cocking roller 146 is contacted, the rod end 327 moves along an inclined surface and, in effect, forces the jaw arms 124 and 125 into a retracted cocked position. In this posture, the jaw arms 124 and 125 retract toward one another such that a pouch retained between the corresponding pairs of jaws 132–134 and 133–135 will be slackened in order to permit the pouch to open to its substantial dimension. Simultaneously with the actuation of the cocking roller 146 to retract the jaw arms 124 and 125 together, a pair of air nozzles is actuated to complete the pouch opening procedure. As shown in FIG. 14 of the drawings, a first air nozzle 330 is provided on a nozzle mounting bracket 331 which is, in turn, carried by the frame 302 via a mounting plate 332, and is shown to be positioned in an inclined or angularized disposition. The first air nozzle 330 operates to direct a jet of air against the extended rear lip of the pouch to commence the pouch opening operation. Sequentially, a second air nozzle 334 similarly carried by the nozzle mounting bracket 331, is actuated to direct a jet of air directly down into the central portion of the pouch. It will be appreciated that upon actuation of the first and second air nozzle 330 and 334, respectively, and the simultaneous operation of the pouch opening cylinder 325 to force the rod end 327 thereof forwardly thereby to cock the jaw arms 124 and 125, the pouch is induced to open due to the slackening of the pouch from side to side as well as the introduction of air into the pouch in order to complete the opening function.

Finally, in connection with the air cylinder assembly which controls the actuation of the imprinting assembly 305, there will be noted that an adjustment assembly (not shown) is provided which permits the adjustment of the imprinting assembly 305 in order to control the horizontally arcuate movement of the imprinting assembly 305. Once again, this structure is deemed to be well within the knowledge of the art and the particular means by which the imprinting assembly 305 is caused to pivotally swing throughout a horizontal arc and adjust it to insure a proper arc and proper printing is considered to be within the scope of the existing art.

It will be appreciated that once the pouch has been imprinted in the manner set forth hereinabove, and the pouch properly opened by both causing a retraction of the jaw arms 124 and 125 toward one another while simultaneously introducing a double jet of air against and into the food pouch, the indexing means is then actuated to rotate the turret 100 and bring the bag to the next adjacent circumferentially spaced processing station.

DETAILED DESCRIPTION OF FOOD LOADING STATION

Figure 15:
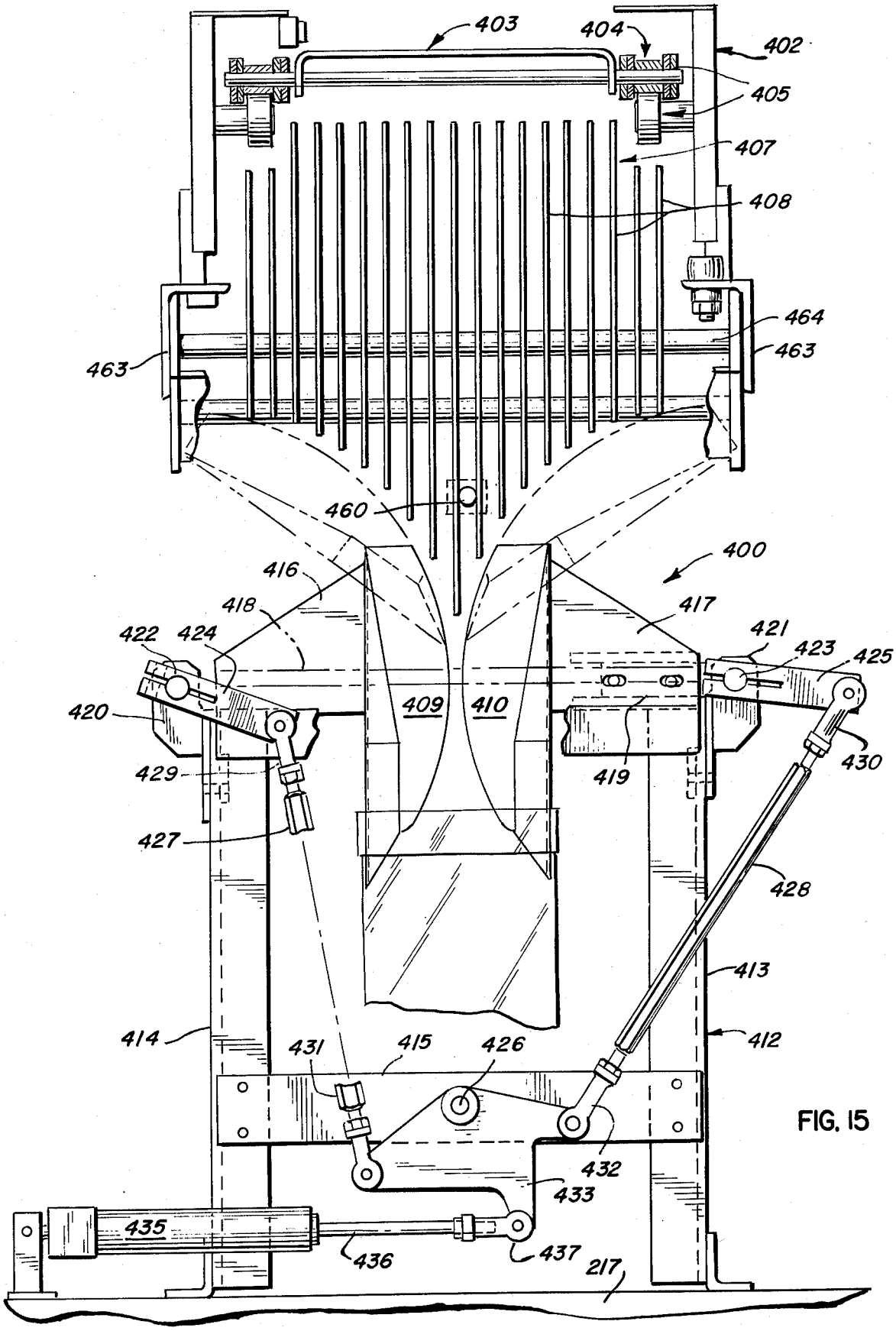
FIG. 15 is a front elevational view showing the details of construction of the loading station.
Figure 15A:
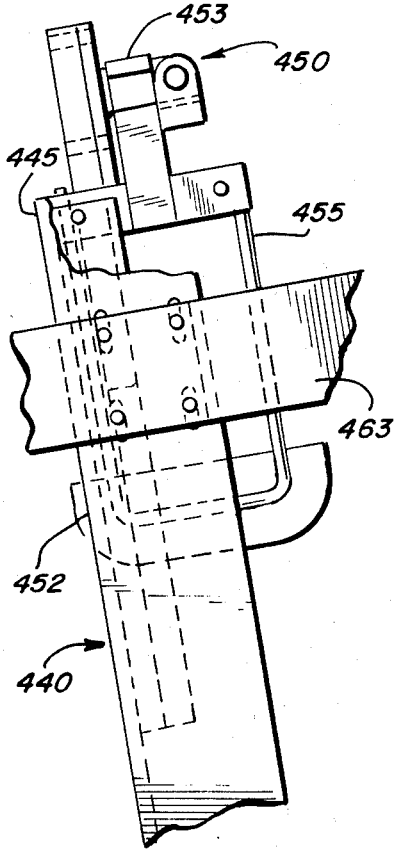
FIG. 15A is a back elevational view showing the details of the mounting assembly for mounting the rod head assembly on the frame portion of the station.
Figure 16:
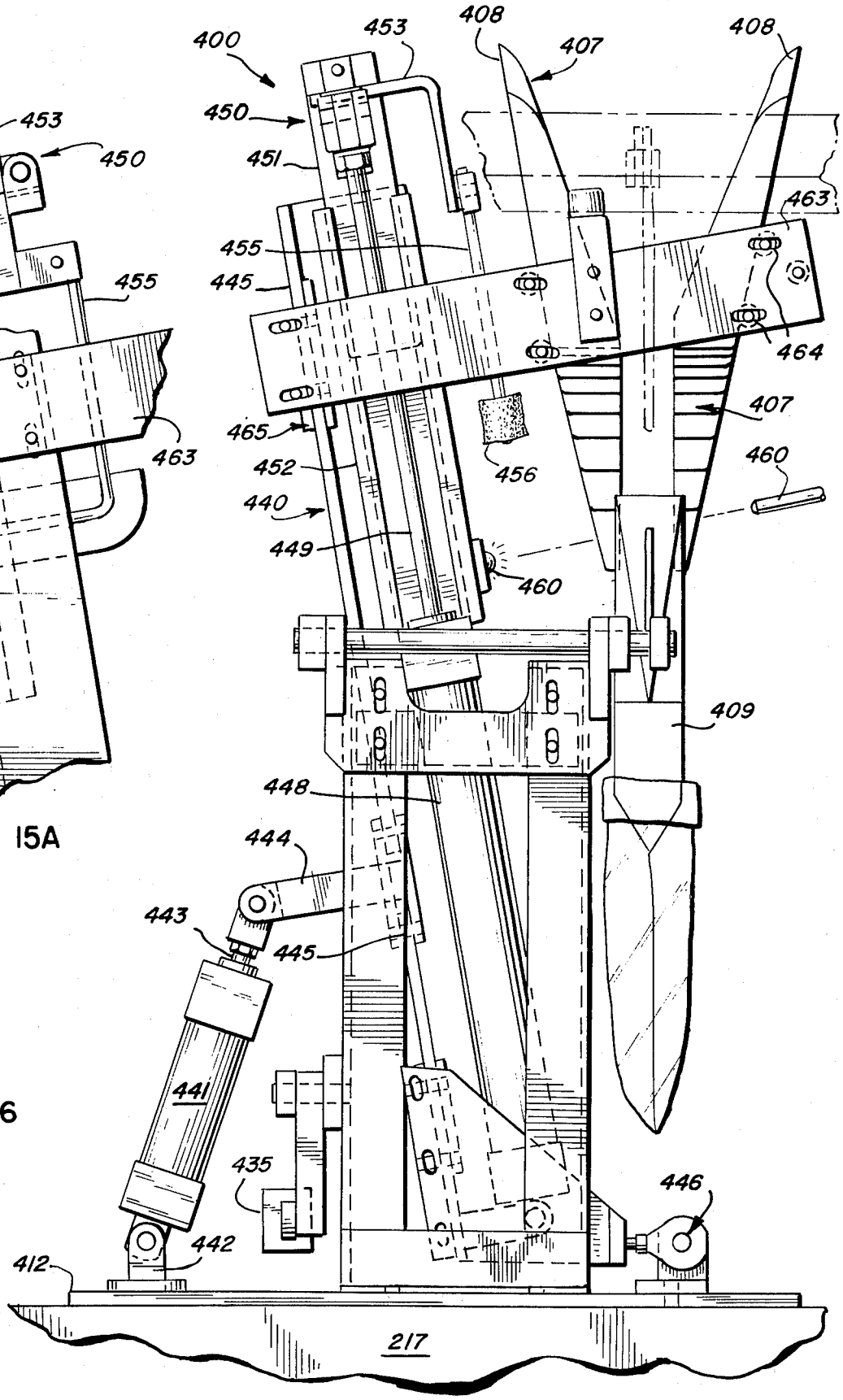
FIG. 16 is a side elevational view, partly in cross section and in phantom, again showing the details of construction of the loading assembly for loading the food product into the food pouch carried by the turret.

With reference to FIGS. 15 and 16 of the drawings, the details of construction of the meat loading station, generally referred to by the numeral 400 are illustrated.

It will be observed that the meat loading station 400 is located under a conveyor assembly 402 which is formed by a tray conveyor 403 carried on two roller chains 404, the rollers 404 being supported by guides 405 in a manner well known in the art. It will be appreciated that individual stacks of meat or other food products to be loaded into the food bags are carried by the tray conveyor 403, generally from a cutting and stacking operation or station, to the subject packaging machine of the present invention. As the stacked meat products arrive at the meat loading station, the meat products are dropped off of the trays 403 into a loading chute 407 which is formed by a plurality of chute members 408. The loading chute 407 guides the stacked meat products into a pair of scoops 409, 410, respectively, which are carried by the support table 217. As shown in FIG. 15, it will be observed that the meat loading station 400 is supported on the support table 217 by a station frame 412 formed by a pair of frame members 413 and 414, respectively. The reciprocating and pivotal mounting and movement of the scoops 409 and 410 is illustrated in FIG. 15 of the drawings.

Each of the scoops 409 and 410 is carried by a corresponding scoop arm support 416 and 417, respectively, which, in turn, carries the scoop arms 418 and 419, respectively. Each of the scoop arms 418 and 419 is pivotally mounted to corresponding pivot brackets 420 and 421 by means of a pivot shaft 422 and 423, respectively. The shafts 422 and 423 are, in turn, secured to a pivot lever 424 and 425 which are controlled in their pivotal movement by a pair of connecting rods 427 and 428, respectively. It will be observed that the upper rod ends 429 and 430 are connected to the respective pivot levers 424 and 425, respectively, and the lower rod ends 431 and 432 are pivotally secured to the master scoop lever 433. The master lever 433 is, in turn, pivotally mounted on a frame cross brace 415 by a pin 426 such that the master lever 433 may pivot about pin 426. It will be appreciated from FIG. 15 of the drawings, that the pivot brackets 420 and 421 are, in turn, carried by the frame members 413 and 414 adjacent the upper portion thereof such that the scoops 409 and 410 carried by the scoop arms 418 and 419, respectively, are in turn supported by the station frame 412.

Again, with reference to FIG. 15 of the drawings, there will be observed a master lever cylinder 435 which includes a cylinder rod 436 having a cylinder rod end 437 pivotally mounted on the master lever 433. It will, therefore, be appreciated that as the cylinder rod 436 reciprocates in the cylinder 435, the cylinder rod end 437 will effect a pivotal movement of the master lever 433 causing the connecting rods 427 and 428 to reciprocate accordingly. The reciprocating movement of the connecting rods 427 and 428 will cause a corresponding movement in the pivot levers 424 and 425, respectively, which due to the interconnection thereof through the pivot pins 422 and 423 with the scoop arms supports 416 and 417, will cause a reciprocating movement of the scoops 409 and 410 between the positions shown in solid lines in FIG. 15 and the position in the phantom lines in FIG. 15. Hence, it will be observed that when the cylinder rod 436 is fully retracted into the cylinder 435, conecting rod 427 is forced upwardly while connecting rod 428 is pulled downwardly, and due to the manner in which the respective connecting rods 427 and 428 are interconnected with the corresponding pivot levers 424 and 425, the scoops 409 and 410 will move upwardly under the loading chute 407 to receive a load of meat products therein. Upon actuation of the cylinder 435, the cylinder rod 436 will move out of the cylinder 435 causing the reverse action to occur on the master lever 433 and a corresponding reciprocating movement of the two connecting rods 427 and 428. This reciprocating movement will thereby lower the scoops 409 and 410 into a loading position with respect to the bag carried on the turret (see phantom line, FIG. 15), to commence the loading of the meat product into the food pouch.

In FIG. 16 of the drawings, the details of construction of the loading ram are illustrated. The ram assembly generally referred to by the numeral 440 includes a positioning cylinder 441 which is pivotally mounted to the station frame 412 by a bracket 442. The positioning cylinder 441 is provided with a cylinder rod 443 which is pivotally mounted, in turn, on a clevis plate 444. The clevis plate 444 is, in turn, fixedly secured to a ram support frame 445, the lower end of which is pivotally mounted on the station frame 412 at pivot point 446. It will be appreciated that as the cylinder rod 443 reciprocates in the cylinder 441, the ram support fraem 445 will move alternatively between a forward ramming position and a rearward rest position, the rearward rest position being shown in FIG. 16.

The ram support frame 445 also carries a ram cylinder 448 which is provided with a ram cylinder rod 449 reciprocable therein. The ram cylinder rod 449 is provided with a rod head assembly 450 at the upper end thereof, which in turn, operates the food ram in a manner to be described hereinbelow.

The rod head assembly 450 includes a ram rod eye 451 which is connected to the ram cylinder rod 449. The ram rod eye 451 reciprocates within a slider bar guide 452 which assumes a generally "U" shaped configuration with inturned lateral ends in order to contain the ram rod eye 451 therein. The upper portion of the ram rod eye 451 carries a ram bracket 453 fixedly secured thereto, the ram bracket 453 supporting a ram 455. In the preferred embodiment, the ram 455 takes the form of a nylon bristle brush, or a pair of such nylon bristle brushes, represented by the numeral 456 (FIG. 16).

As shown in FIG. 16 of the drawings, when the positioning cylinder 441 has the cylinder rod 443 in the retracted position, the ram support frame 445 is in a retracted rest position, out of the path of the food product passing through the loading chute 407 into the scoops 409 and 410. In the preferred embodiment, a photo detection cell 460 and reflector 461 (FIG. 15) is provided at the lower end of the ram assembly 440 to detect the presence of the meat product being loaded in the scoops 409 and 410. Assuming that a meat product is detected, the electrical circuitry established in the loading station will activate the positioning cylinder 441 to extend the cylinder rod 443 thereby to reciprocate the ram support frame 445 into an operating position above the scoops 409 and 410. The ram cylinder 448 is actuated to retract the ram cylinder rod 449 causing the ram rod eye 451 to slide downwardly within the confines of the slider bar guide 452 bringing the ram 455 through the scoops 409 and 410 thereby transferring the food product therefrom and positively inserting the same in the food pouch which is still carried on the turret face 102 of the turret 100. Upon completion of this processing cycle, all of the elements return to their rest position, for example. The ram cylinder rod 459 extends from the ram cylinder 448, and the complete ram assembly 450 is brought back out of the operating position of the loading chute 407 and scoops 409 and 410.

It will be appreciated from the above description that the movable elements of the third loading station consist of the scoops 409 and 410 which move from a meat receiving position shown in phantom in FIG. 15 to an insertion position shown in solid lines in FIG. 15. In addition, the ram assembly 440 is caused to reciprocate forwardly into an insertion position over the scoops 409 and 410 once the meat product has been detected by the photoelectric detector 460 and actuate the ram 455 to pass between the scoops 409 and 410 to insure removal of the food product from the scoops 409 and 410 and to positively insert the same into the food pouch. As shown in FIG. 16, the loading chute 407 is carried on the ram support frame 445 by a spreader bar 465, a pair of chute support bars 463, and chute cross braces 464.

Upon completion of the processing cycle occurring at the meat loading station, a food pouch carried on the turret 100 has now been imprinted, opened, and loaded with a meat product and is now ready for further processing. It will also be appreciated that the indexing of the turret 100 which occurs is the result of the interconnection, electrically as well as mechanically, between the processing stations described hereinabove and the indexing means heretofore briefly described. Upon completion of the meat loading cycle, the indexing means is actuated to again index the turret 100 to the next processing station.

In the preferred embodiment of the invention, it is deemed desirable to have a detection station formed as part of the meat loading station in order to insure that the food pouch is properly opened and in the correct position to receive meat, prior to the meat loading operation.

Figure 16A:
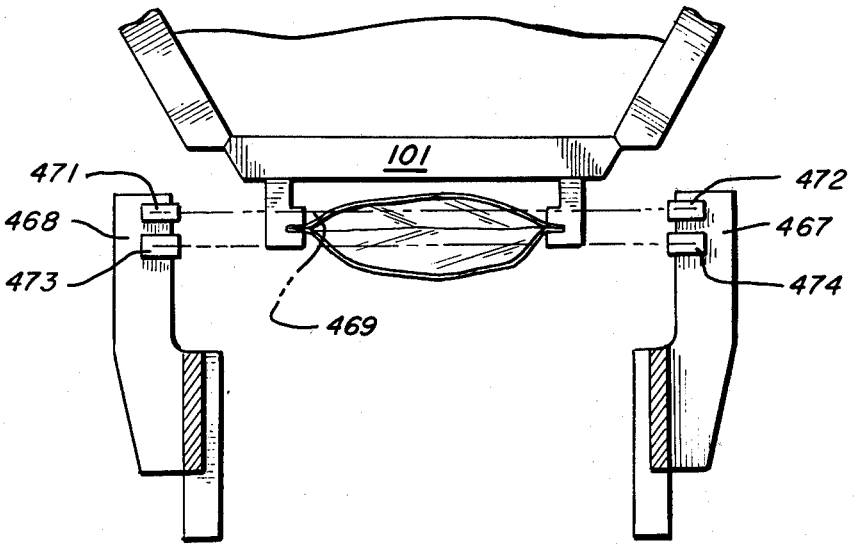
FIG. 16A shows a plan view of the detection means associated with the food loading station to determine the presence of a properly opened food pouch prior to the loading operation.

As shown in FIG. 16A, the frame members 413 and 414 are provided with carrying brackets 467 and 468 fixedly mounted thereon. It will be noted that the carrying brackets 467 and 468 are constructed to be positioned on opposed sides of the turret face 102 which carries the food pouch thereon. The carrying brackets 467 and 468 are further provided with a first pair of photoelectric cell and detector 471 and 472, positioned to extend a beam there across adjacent the rear portion of the food pouch, and a second pair of photoelectric cell and receiver 473 and 474 adjacent the forward portion of the food pouch and designed to transmit and receive the second beam therebetween. By positioning one beam adjacent the rear portion of the pouch as well as the front portion of the pouch, a properly opened pouch will cause the interruption of both means and result in the triggering or activaction of the food loading cycle.

If either of the two beams fail to be interrupted, this will indicate that a pouch is not properly opened and a signal is transmitted to a memory system in the next adjacent station. In addition, the food loading cycle will fail to be activated and thereby prevent meat from being loaded into an improperly open pouch. At that point, the indexing means will be activated to index the turret 100 to the next adjacent station to continue the packaging operation of the entire machine.

EMPTY BAG DISCHARGE STATION

The next adjacent station consists of a discharge station and details of construction thereof are shown in FIG. 17 through 20 of the drawings.

It will be observed that the discharge station 500 is formed by a cylinder frame 502 which is fixedly secured to the support table 217 by means of attachment ears 503 and 504 respectively. The cylinder frame 502 includes a pair of opposed cylinder supports 506 and 508 which support a pair of cylinders 510 and 515 respectively. Each cylinder 510 and 515 is provided with a corresponding cylinder rod 511 and 516, the cylinder rods each having rod heads 512 and 517 associated therewith. It will be appreciated as the cylinder rods 511 and 516 move forwardly, the rod heads 512 and 517 will similarly move forward.

As was indicated in connection with the detection portion of the meat loading station, if an improperly opened pouch is indexed into the meat loading station 400, and the two pairs of photoelectric cells and receivers 471, 472, 473, and 474 detect such an improper opened pouch, a signal has been transmitted into the memory system incorporated as part of the electronic circuitry of the overall machine, which will in turn send a signal to activate the cylinders 510 and 515. Activation of these two cylinders 510 and 515 will cause the extension of the cylinder rods 511 and 516 such that the rod heads 512 and 517 move forwardly. Upon the full extension of the cylinder rods 511 and 516, the rod ends 512 and 517 respectively will make contact with the strike rollers 138 (FIG. 3) which will move against the jaw levers 136 thereby opening the front jaw teeth 134 and 135 respectively, and in effect, release the food pouch from the turret face 102. In the present embodiment, the detection portion of the meat loading station 400 is operated with two photoelectric cells 471 and 473 as the detection device for the reason that it is contemplated to use plastic food pouches in the packaging operation which will cause an interruption in the beams produced from such devices. However, it is contemplated and well within the skill of the art that if different types of containers are used within the environment of the present invention, the detection systems employed can be modified accordingly.

Again, assuming that the food package has passed the inspection of the food loading station 400, the indexing means is actuated to rotate the turret 100 to the next processing station for further processing.

DETAILS OF DESCRIPTION OF VACUUM AND SEALING STATION

The turret face and back-up plate assembly 103 carried by the turret 100 is indexed to the vacuum and sealing station, generally referred to by the numeral 600. In this station, a vacuum is created surrounding the open food package, the food package is then purged with nitrogen, and simultaneously, the food pouch with the meat product contained therein is completely sealed. Following below is the detailed description of the various component portions of the assembly forming the vacuum and sealing station 600.

Figure 21:
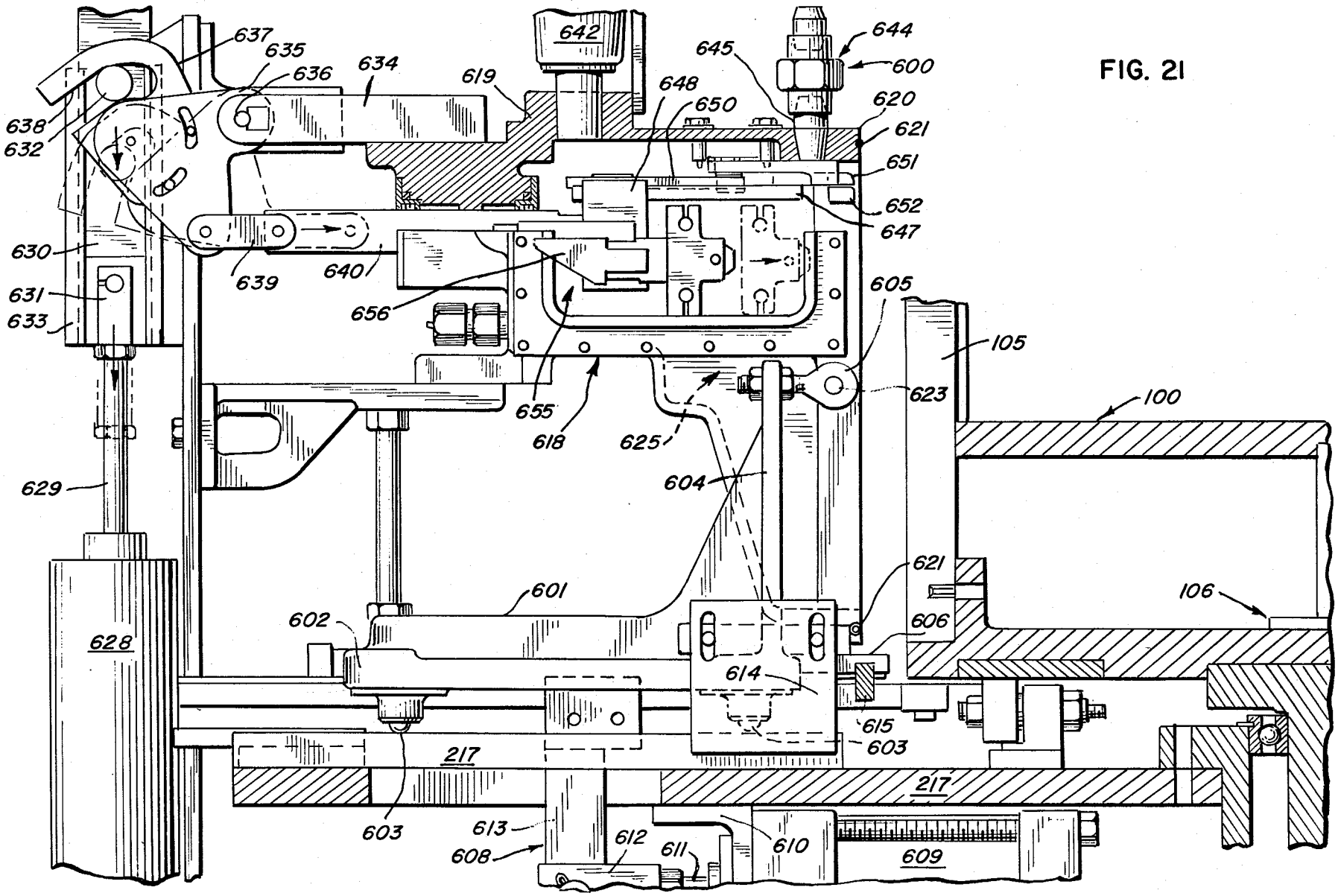
FIG. 21 is a side elevational view, partly in cross section, showing the details of construction of the vacuum hood assembly, including the purging gas source, and the heat sealing bar assembly.

With specific reference to FIGS. 21 and 22 of the drawings, it will be observed that the turret 100 carrying the turret face and back-up plate assembly 103 is indexed by the indexing assembly 106 to a position in juxtaposition with vacuum and sealing station 600. The vacuum and sealing station 600 is shown to be supported on the support table 217. The station 600 includes carriage frame 601 which supports the carriage 602 which, in turn, rides on the support table 217 by means of a plurality of ball rollers 603. In the preferred embodiment, a series of four ball rollers 603 are utilized to permit two directional rolling movement of the carriage 602, made possible by the pivot connection 615 to carriage shuttle 614. Formed as a part of the carriage is an upstanding hood support 604 which has a pair of ball rod ends 605 fixedly secured thereon. The lower portion of the carriage 602 includes an extension portion 606 which functions in cooperation with the reciprocating assembly generally referring to by the numeral 608.

The reciprocating assembly includes a carriage cylinder 609 which is secured to the support table 217 by a cylinder bracket 610. The carriage cylinder 609 is provided with a cylinder rod 611, the outer end of which is secured to a connecting plate 612. The connecting plate 612 is in turn pinned to a carriage plate 613 which, in turn, is fixedly secured to a carriage shuttle 614. It will be observed that the carriage shuttle 614 is pinned to the extension portion 606 of the carriage 602 by connecting pins 615 such that upon the movement of the carriage shuttle 614, the carriage 602 will similarly reciprocate. It will be appreciated that the reciprocation of the carriage 602 is accomplished by actuating the carriage cylinder 609 to cause a reciprocatory movement of the cylinder rod 611 which, in turn, moves the connecting plate 612, carriage plate 613, and carriage shuttle 614. It will further be observed that this movement is reciprocatory relative to the turret face and back-up plate assembly 103 of the turret 100. It will also be appreciated that since the carriage 602 moves on the ball roller 603, and is supported by ball rod ends 605, the hood chamber 625 is easily positionable against the face of the turrent face 102.

The hood assembly, generally referred to by the numeral 618 is shown to be formed by a hood 619 which extends around the top, sides, and bottom of the hood assembly 618. The front face 620 of the hood assembly 618 is provided with a continuous "O" ring seal around its perifery 621. The hood assembly 618 is shown to be pivotally mounted to the carriage 602 by means of the pivotal connection through the ball rod ends 605, the pivotal connection being achieved by means of pivotal pins 623 and pivot connection 615 to carriage shuttle 614 permitting the hood assembly 618 to move in a forwardly and in a universally arcuate pathway in order to insure proper seating of the hood assembly 618 against the turret face 102.

As indicated previously, the hood frame 618 forms a top wall, side walls, bottom wall and back wall for the hood assembly 618 leaving only an open front face 620 bounded by the peripheral edges thereof. Hence, the hood 619 defines a hood chamber generally represented by the numeral 625. It will, therefore, be appreciated that the hood assembly 618 can effect a virtually fluid tight seal with the turret face 102 of the of the turrent 100 due to the rolling action of the ball rollers 603 as well as the pivotal connection of the hood assembly 618 via the pivot pin 623 through rod end 605 and pivot connection 615. Hence, the proper seatment of the front face 620 of the hood assembly 618 is achieved along the horizontal axis, vertical axis, and forward arcuate pathway of the hood assembly 618 against the turrent face 102 carried by the turret 100. The O-ring seal 621 then functions to assure a proper vacuum environment. The seatment feature of the vacuum hood assembly 618 is considered to be an improvement over previously existing vacuum hoods associated with the packaging machine since slight imperfections in the construction of each of the turret faces 102 carried on a turret 100 may be accommodated by means of accommodating the horizontal, vertical, and arcuate movement of the hood assembly 618 necessary in order to achieve a universal seatment of the hood assembly 618 thereon.

The reciprocating movement of the hood assembly 618 is, therefore, achieved by a carriage cylinder 609 which is mounted to the support table 217 thereby to be securely affixed. As indicated, the cylinder 609 includes cylinder rod 611 which is reciprocable therein, the outer end of the cylinder rod 611 being fixedly secured to a connecting bar 613 by means of a clevis 612. The connecting bar 613 is, in turn, connected to the carriage shuttle 614. In this manner, the hood assembly 618 is reciprocated forwardly to seat against the turret face 102. When the cylinder rod 611 is retracted the hood 619 through the medium of pivot connection 615, carriage 602 and ball rod ends 605 is brought firmly in contact with turret face 102 causing the "O" rings 621 to tightly seal thereagainst. A vacuum is drawn in the thusly formed vacuum hood chamber 625 by means of vacuum valve 642 thereby evacuating air from the hood chamber 625. The pouch is then purged of any vestige of air by a jet stream of nitrogen blowing directly into the pouch through valve 644, which includes valve nozzle 645 in open communion with hood chamber 625 purging out any remaining air in the food pouch.

The nitrogen valve assembly 644 is actuated to operate once the vacuum has been established in the hood chamber 625 and immediately prior to the sealing operation. It is considered to be known in the art that electrical and mechanical linkages can be established between the nitrogen valve assembly 644 in order to effect the timed sequencing of the activation of the nitrogen valve assembly 644 in a properly timed response to the establishment of the vacuum in the vacuum hood chamber 625.

During the sealing operation, it is further necessary that the back-up plate 110 be brought forward to a support position in order to provide a proper support base against which the heat sealing bar may effect proper sealing of the food pouch. In addition, it is also necessary that the jaw arms 124 and 125 associated with the turret face and back-up plate assembly 103 be released such that the jaw arms 124 and 125 (FIG. 4) will be fully extended to their furthest lateral position in order to fully stretch the pouch as far as possible. These functions are accomplished by a structure associated with the vacuum hood assembly 618.

It will be observed that the reciprocating press rod 640 is interconnected to a press plunger 647 through a pivot base 648, which is, in turn, formed as a part of the heat sealing bar assembly 655. The forward reciprocating movement of the reciprocating press rod 640 will cause a concomitant forward reciprocating movement of the press plunger 647 and heat sealing bar assembly 655, which extends forwardly to a point such that the same comes into contact with the upper rack 115 of the back-up plate 110 causing the operation of the spur gear 120 and a concomitant reciprocation of the lower rack 112 to move the back-up plate 110 to its forward support position. Simultaneously therewith, a pawl release cam plate 650 terminating in a pawl release lever 651 which, in turn, carries a pawl release roller 652 reciprocates forwardly to strike against the pawl 141 pivotally carried on the turret face 102. As was indicated previously, the pawl 141 acts as a stop for the jaw arms 124 and 125 which are spring loaded by means of the tension spring 130. The striking contact effected between the pawl release roller 652 and the pawl 141 will move the lower portion of the pawl 141 out of contact with the arm stop 131, and due to the biasing effect of the tension spring 130, the jaw arms 124 and 125 will extend laterally outwardly until the same are stopped by the pawl assembly 141.

At this point in the cycle, the carriage cylinder 609 has been actuated in order to move the carriage 602 and the hood assembly 618 into contact with the front face of the turret face 102, and the hood cylinder 609 has similarly been actuated to retract the cylinder rod 611 and move the hood frame 619 into a surrounding position about the turret face 102. A vacuum drawn by the vacuum valve 642 in association with the mechanical force exerted by the air cylinder 609 by means of clevis 612, connecting bar 613 and carriage shuttle 614, has now caused a fluid-tight vacuum environment to be created in the vacuum hood chamber 625. As indicated previously, the nitrogen valve assembly 644 has then been actuated to purge all remaining air from the food pouch and, simultaneously, the press plunger 647 has reciprocated to bring the back-up plate 110 into its forward support position while simultaneously, the pawl release roller 652, has caused the jaw arms 124 and 125 to retract laterally to their furthest dimension to stretch the upper portion of the food pouch.

The sealing operation is actuated by the reciprocating press rod 640 in order to effect a heat seal across the upper lip of the pouch. Once again, it will be observed that the vacuum hood assembly 618 is proviced with the heat sealing bar assembly 655 (FIG. 23) which is carried within the confines of the hood chamber 625. The heat sealing bar assembly 655 includes a yoke 656 which carries a pair of side pivot supports 657 and 658, respectively. The yoke 656 is, in turn, pinned to the reciprocating press rod 640 through the pivot base 648. Pivotally supported between the yoke side pivot supports 657 and 658 is a heat sealing bar 660. The precise construction of the heat sealing bar 660 and the manner in which the same is pivotally secured within the yoke 656 will be described in greater detail hereinafter.

It will be appreciated at this juncture, that upon the movement of the reciprocating press rod 640 in a forwardly direction toward the turret face 102, a concomitant forward movement of the yoke 656 having the heat sealing bar 660 mounted thereon will occur. Touching contact between the heat sealing bar 660 and the food pouch contained within the vacuum hood chamber 625 will not actually occur until the sealing cylinder 628 has been actuated. It will be observed that the sealing cylinder 628 is provided with cylinder rod 629 which is in turn connected to the cam following bar 630 by means of the clevis 631. The upper portion of the cam following bar 630 is provided with a cam follower 632 which reciprocates upwardly and downwardly depending upon the positioning of a cylinder rod 629. The entire cam following bar 630 rides in a follower bar guide 633, which assumes a generally U-shaped configuration with inturned flanges in order to form a guideway for the cam follower bar 630.

It will be observed that the cam follower 632 rides in a cam slot 638 which is formed on a cam plate 637. The cam plate 637 is, in turn, pivotally secured to a base plate 635. The base plate is pivotal at pivot point 636 which is carried on a connecting bracket 634. The lower portion of the base plate 635 is provided with a connecting line 639 which connects the base plate 635 with the reciprocating press rod 640. Hence, it will be appreciated that touching contact between the heat sealing bar 660 and the food pouch contained within the vacuum hood chamber 625 will only occur after the sealing cylinder 628 has been actuated such that the cylinder rod 629 retracts downwardly for a distance thereby causing the cam follower bar 630 to move downwardly within the follow bar guide 633. This action causes a pivotal motion to occur in cam plate 637 in view of the positioning of the cam follower 632 within the cam slot 638. As the cam follower 632 moves downwardly in the cam slot 638, the cam plate 637 will pivotally move about pivot point 636 thereby moving the reciprocating press rod 640 and the connecting link 639. This will, in turn, move the heat sealing bar 660 into positive touching contact with the food pouch contained within the vacuum chamber 625. This action eliminates variations in the sealing pressures usually resulting from variations of plant air pressure. Furthermore, the cam plate 637 is adjustable with respect to the base plate 635 and the cam follower 632 in order to permit changes in the positioning of the cammed surfaces of the cam slot 638 relative to the cam follower 632 and hence, permits the attainment of any desired pressure transmittal to the front sealing face 661 of the sealing bar 660 as the cylinder mechanism 628 is actuated. Due to the improved construction of the heat sealing bar 660 (to be described hereinafter) as well as the manner in which the heat sealing bar 660 is mounted on the yoke 656, as well as in view of the improved mechanical force achieved by the cam follower 632 when moving down the follower bar guide 633 throughout the action of the cam follower 632 moving in the cam slot 638, resulting in a substantially improved heat seal of the food pouch.

Upon completion of the processing function set forth hereinabove, all of the elements return to their rest position, the carriage cylinder 609 releasing the cylinder rod 611 therefrom to retract the carriage 602 and the hood assembly 618 carried thereon away from the turret face 102, while simultaneously the sealing cylinder 628 reciprocates the cylinder rod 629 upwardly to retract the heat sealing bar assembly 655. Then the hood cylinder 609 extends rod 611 through clevise 612 to release the hood assembly 618 from the turret face 102. The atmosphere is vented, once again, through the vacuum valve 642 whereupon the indexing assembly 106 operates to move the turret face and back-up plate assembly 103 having the food pouch mounted thereon to the next adjacent station.

With reference to FIG. 22 of the drawings, it will be observed that for the sake of ease of operation, the support table 217 is provided with a pair of upstanding supports 616, each of which has an inwardly extending roller guide 617 mounted thereon. The carriage 602 is provided with opposed carriage rollers 607 to guide the carriage along the path defined by the roller guides 617. These roller guides 617 prevent the carriage 602 and thereby the vacuum chamber 625 from lifting up due to sealing bar pressure, thereby maintaining vacuum tight conditions in the chamber 625.

With regard to FIGS. 23 through 26 of the drawings, the details of construction of the yoke 656 having the heat sealing bar 660 mounted thereon are shown. As indicated previously, the yoke 656 is provided with a pair of yoke side pivot supports 657 and 658 respectively. The heat sealing bar 660 is provided with a front sealing face 661 and a rear face 662. Mounted on the rear face 662 are an opposed pair of sealing bar pivot plates 663 and 664 respectively. The sealing bar pivot plates 663 and 664 are mounted to the rear face 662 of the sealing bar 660 and extend laterally along the end edges of the sealing bar. The pivotal mounting of the heat sealing bar 660 to the yoke 656 is accomplished by means of a pair of pivot pins 665 which function to pivotally pin the sealing bar pivot plates 663 and 664 to the corresponding yoke side pivot supports 657 and 658 respectively. In addition, from a view of FIG. 26 of the drawings, it will be noted that the pivot point provided is positioned at the front sealing face 661 of the heat sealing bar 660 and in line with the upper edge of the heat sealing bar 660. The pivotal mounting of the heat sealing bar 660 to the yoke 656 in this manner results in an improved heat sealing line of the food pouch since, in the sealing operation, the heat sealing bar 660 would have only a small travel arc in order to effect complete contact with the food pouch. In connection with the foregoing description, it is customary in heat sealing machines or in packaging machines incorporating heat sealing bars to have the heat sealing bar pivotally mounted, generally along the central axis of the hear sealing bar. This, then, requires that the heat sealing bar, when reciprocated into its heat sealing posture against the food container, pivotally swing for an extended travel arc and should there be any cocking of the heat sealing bar from side edge to side edge, an imperfect seal results on the food pouch or other container. The novel manner of pivotally mounting the heat sealing bar 660 to the yoke 656 at the front face 661 of the sealing bar 660 solves the difficulty heretofore found with regard to such heat sealing operations.

With specific reference to FIGS. 27 through 30 of the drawings, the details of construction of the improved heat sealing bar 660 of the present invention are illustrated. In the past, it has been found somewhat difficult to remove or exchange heat sealing bars which have failed due to protracted operation in view of the fact that a heat sealing bar must contain a heating cartridge or a source of heat associated therewith in order to produce heat. Generally, a heat sealing bar will be cored or drilled and have a heating cartridge positioned through the center portion thereof. In order to remove the heating cartridge and exchange the same, it is necessary to remove the cartridge from the central heat bar core and to then insert a new cartridge in position. This occurs fairly often in any automatic continuous manufacturing facility where thousands of food packages are heat sealed on a daily basis. The present invention seeks to improve heat sealing bar assemblies such that the heat sealing bar will be easily replaceable.

Figure 27:
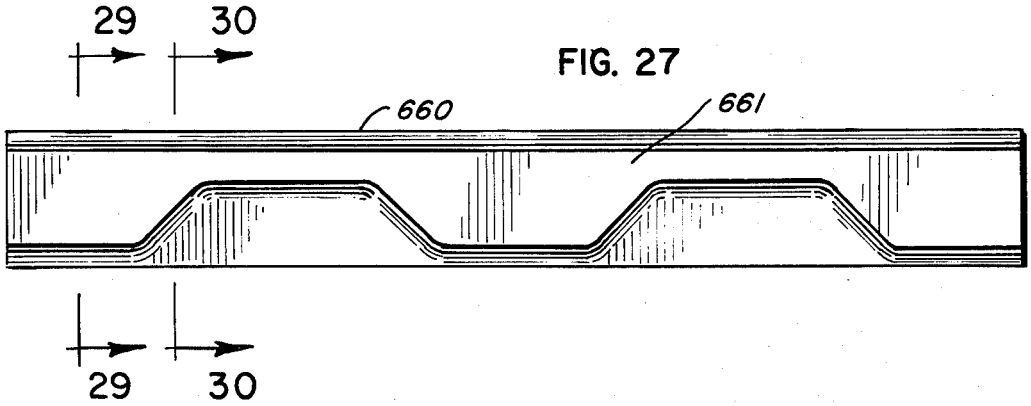
FIG. 27 is a top plane view of the heat sealing bar of the present invention.
Figure 28:
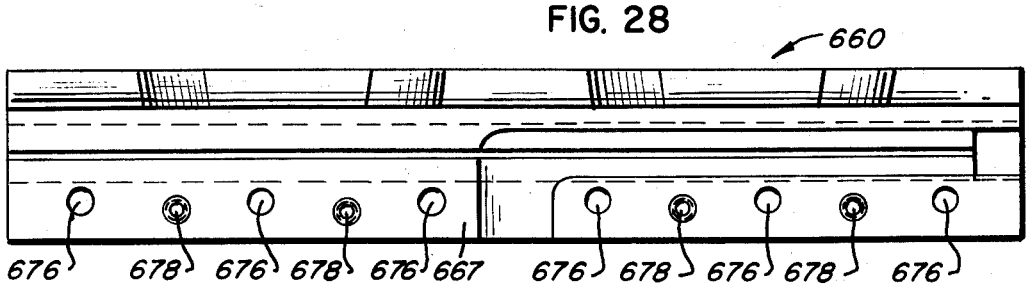
FIG. 28 is a bottom plane view showing the details of construction of the sealing bar of the present invention.
Figure 29:
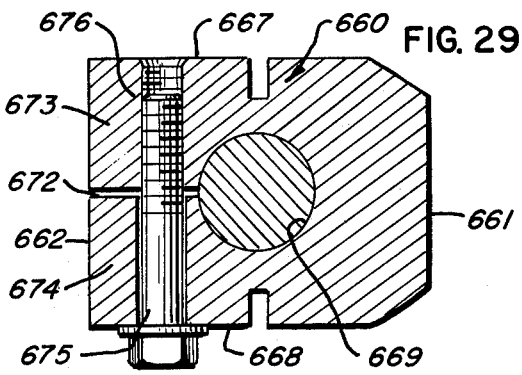
FIG. 29 is a side cross sectional view of the sealing bar taken in the direction of the arrows along line 29—29 of FIG. 27.
Figure 30:
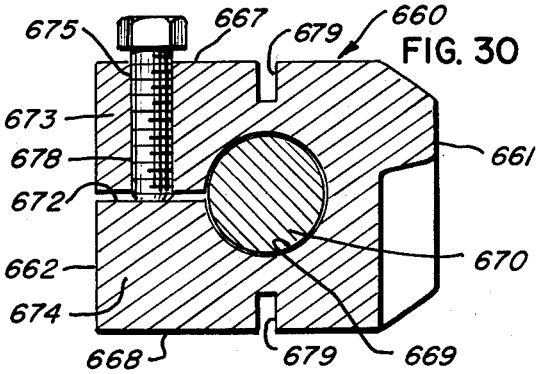
FIG. 30 is a side cross sectional view of the subject sealing bar taken in the direction of the arrows along the line 30—30 of FIG. 27.
Figure 26:
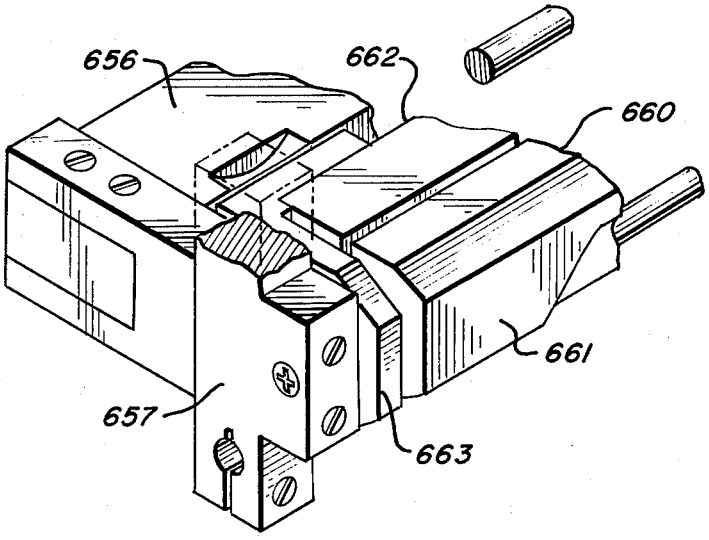
FIG. 26 is a perspective view showing the heat sealing bar and pivotal connection with the supporting yoke.

With reference to FIG. 27 of the drawings, the heat sealing bar 660 of the present invention is illustrated. There will be observed a front heat sealing face 661, which in this instance, assumes a double-bridged configuration, however, in practice may assume any desired heat sealing pattern or configuration. In FIG. 28 of the drawings, the top wall 667 of the heat sealing bar 660 is illustrated. It will be observed that a plurality of apertures are positioned along the lateral extant of the heat sealing bar 660. With reference to FIGS. 29 and 30 of the drawings, the details of construction of the heat sealing bar 660 are illustrated. Once again, it will be observed that heat sealing bar 660 includes a front sealing face 661, and a rear support face 662. The top wall 667 is illustrated along with the bottom wall 668. In addition, the heat sealing bar is shown to be centrally cored as at 669 and is adapted to contain the cartridge 670 (FIG. 30). There will also be observed a traversing slot 672 which extends from the rear support face 662 and cuts through the heat sealing bar 660 to the central core 669 thereof. The slot 672, in effect, divides the rear portion of the heat sealing bar 660 into two rear opposed portions 673 and 674, respectively. As shown in FIGS. 28 through 30 of the drawings, extending from the top wall 667 to the bottom wall 668 are a series of six clamping apertures 676 which extend completely through the rear portions 673 and 674 of the heat sealing bar 660. In addition, it will be noted that the clamping apertures 676 are threaded thereby to accommodate a threaded screw therethrough. It will be appreciated that once the heating cartridge 670 is inserted into the central core 669, a threaded screw 675 may be inserted therethrough and screw-threaded into the opposed rear portion 673 of the heat sealing bar 660 in order to tighten down the opposed rear portions 673 and 674 thereby to tighten the heating cartridge 670 within the central core 669.

Again, with reference to FIG. 28, there will also be noted a series of four jack holes 678 which are threaded apertures which extend only through one of the rear portions 673 of the heat sealing bar 660. From a view of FIG. 30 of the drawings, it will be observed that should any difficulties be encountered with the heating cartridge 670 whereby the same must be replaced, the heating cartridge 670 may easily be removed from the central core section 669 by simply inserting threaded screws 675 into the jack holes 678 which extend only through one of the rear portions 673 of the heat sealing bar 660. Once the screw 675 reaches the end of the jack hole 678, the screw makes contact with the upper portion of the opposed rear portion 674 and continued screwing down on the threaded screws 675 will operate in the manner of a jack to spread the opposed rear portions 673 and 674 along the traversing slot 672 and thereby have the effect of opening the central core portion 669.

It will further be noted that the heat sealing bar 660 is provided with stress slots 679 which function to facilitate the jacking procedure when the threaded screws 675 are threaded into the jack hole 678 and travel across the traversing slot 672 until contact is made with the rear portion 674 of the sealing bar 660. It will, therefore, be appreciated that the two rear portions 673 and 674, when being spread apart by the threaded screw 675 will cause a stress which is relieved by the stress slots 679 thereby further facilitating the removal of the heating cartridge 670 as heretofore indicated.

It will, therefore, be appreciated that in addition to providing an improved packaging machine of the type heretofore described, the invention further provides, as a subassembly, an improved vacuum chamber of the type described hereinabove as well as an improved heat sealing bar assembly and heat sealing bar associated therewith such that the overall functioning of the packaging machine is significantly improved in order to produce a food package which is sterile and properly sealed.

DETAILED DESCRIPTION OF DISCHARGE STATION

Figure 31:
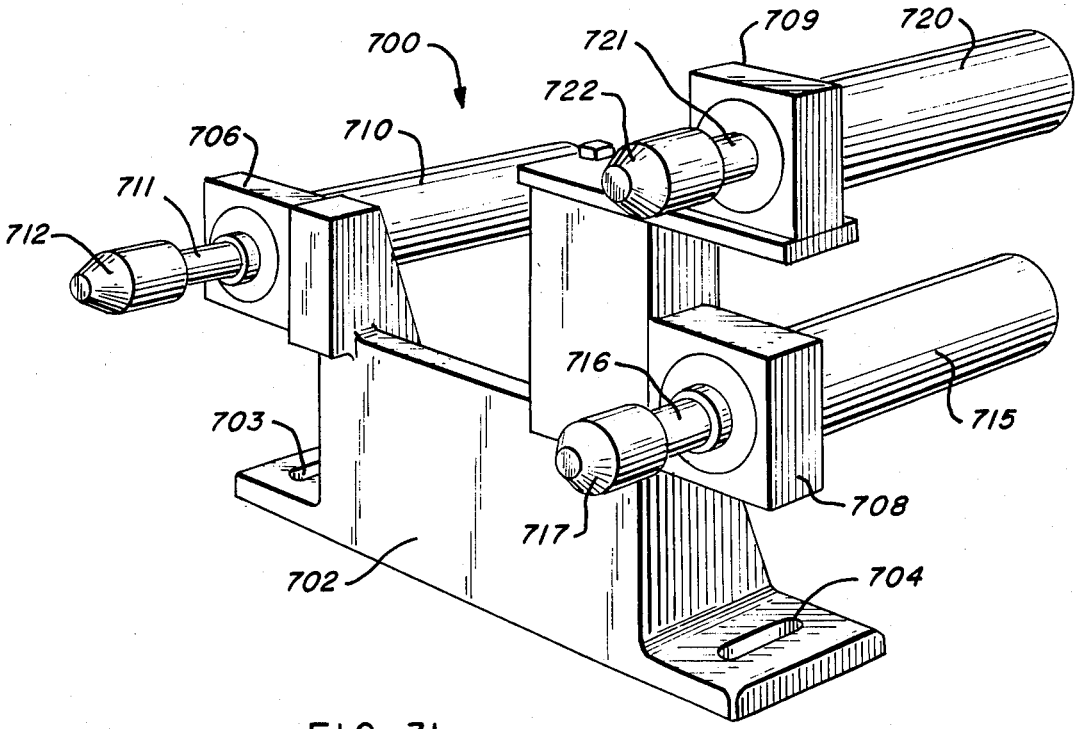
FIG. 31 is a perspective view showing the details of the discharge jaw clamp cocking assembly forming the subject matter of the sixth processing station for discharging a completed food package from the turret of the subject packaging machine, and cocking clamp levers for pouch pickup.

The final station associated with the packaging machine of the present invention relates to the discharge station which operates to discharge a food package which has been imprinted, loaded, purified, and heat sealed, from the turret 100 to a conveyor, or other collection assembly for further handling. The details of the discharge station of the present ivnention are shown in FIG. 31 of the drawings.

Briefly, the discharge station, generally referred to by the numeral 700 resembles the empty bag discharge station 500 and, in fact, operates in a similar manner with the exception that the discharge station 700 further includes a device for effecting the cocking of the jaw arms 124 and 125 associated with the turret face back-up plate assembly 103. The discharge station 700 is formed by a frame 702 which is provided with fastening slots 703 and 704, respectively, to permit the fastening of the frame 702 to the support table 217. The frame 702 carries a pair of laterally extending support ears 706 and 708 each of the support ears 706 and 708 carrying a discharge cylinder 710 and 715. Each discharge cylinder is provided with a cylinder rod 711 and 716, respectively, which terminates in a ram head 712 and 717, respectively.

As was indicated previously in connection with the detection station 500, when a food package has been rotated by the turret 100 to the discharge station 700, the discharge cylinders 710 and 715 are actuated to move the cylinder rods 711 and 716 forwardly such that the ram heads 712 and 717 come into contact with and strike against the strike rollers 138 positioned on the turret face 102. The strike rollers in turn cause the pivotal movement of the jaw levers 136 thereby to release the front jaw members 134 and 135 such that the food package theretofore retained therein will drop out.

In addition, it will be noted that the frame 702 further includes an upper support ear 709 which carries a cocking cylinder 720. The cocking cylinder 720 similarly is provided with a cylinder rod 721 terminating in a cylinder ram head 722. Upon actuation of the cocking cylinder 720, the cylinder rod 721 moves forward until the cylinder ram head 722 makes contact with the cocking roller 146 positioned on the turret face 102. The striking contact with the cocking roller 146 will cause the jaw arm 124 to retract inwardly toward the opposed jaw arm 125. As jaw arm 124 moves inwardly against the urging force of the spring 130, both jaw arms 124 and 125 will move simultaneously due to the spring button 126 which interconnects the two. The jaw arms 124 and 125 will, therefore, cock to their first cocking position as previously described in connection with the turret face and back-up plate assembly 103.

It will be appreciated that as a result of the processing function achieved at the discharge station 700, the jaw members 132-134 and 133-135 have been opened, and the jaw arms 124 and 125 have been cocked inward such that the assembly is now ready to receive another food pouch from the magazine 201 due to the action of the reciprocating deposition head 220.

As has been indicated previously, the packaging machine of the present invention is designed to operate on a continuous basis, and it has been found that by providing the turret 100 with a hexagonal head 101, and further given the fact that there are 6 processing stations, the indexing assembly 106 can be arranged, both electrically and mechanically, to cause the processing function to continually occur in connection with each of the turret faces 102 as the turret 100 is caused to rotate. In addition, by designing the subject packaging machine as a circumferential processing system, the amount of actual manufacturing floor space necessary to effect the complete food container depositing, imprinting, opening, loading, purifying and sealing operation can be greatly minimized. In addition, in accordance with the foregoing description, it will be appreciated that the complete processing of the food package from an unfilled pouch to a filled and sealed container is done on a completely automatic basis. As has been indicated, various detection means can be incorporated into the machine whereby the machine will be automatically stopped should any malfunction occur, either in terms of a misplacing of the pouch onto the turret 100, or in terms of a failure to have a food product arrive for loading purposes. In such an event, the operator need only correct the malfunction, and reactivate the indexing assembly 106 of the machine to commence the continuous and automatic processing system.

It will also be appreciated that while specific reference has been made herein to particular gearing and cam assemblies in connection with each of the processing stations, it is deemed to be well within the knowledge of the art to modify such gearing and cam assemblies in order to accomplish the stated function. Obviously, factors such as the availability of materials, and cost factors, will have an impact upon the particular type of gears or cams to be utilized in connection with any of the given stations. Clearly, the relevance of the present invention is the provision of a rotatable turret 100 which operates in association with a plurality of circumferentially arranged processing stations to accomplish each of the necessary processing functions to a given food package such that a completed and sealed food package is discharged from the machine and ready for further packing or other handling. It has been found that food packages processed according to the packaging machine of the present invention are discharged in a condition ready for further packaging in boxes or other packages in accordance with the size containers required by the consuming trade. Hence, very little further handling is required in connection with food packages discharged from the manufacturing system disclosed herein.

It will also be appreciated that two other areas of novelty are considered to be relevant with regard to the present invention. In this connection, the vacuum hood assembly 618 is considered to present novel features since the vacuum hood assembly 618 includes features such as self-positioning adjustment means associated therewith, which includes the structure of the supporting carriage which moves on a plurality of ball rollers, and further, from the standpoint that the vacuum hood carries as an integral part thereof both the purification means formed by the nitrogen gas valve, as well as the heat sealing bar assembly. As has been indicated previously, since the purification assembly as well as the heat sealing bar assembly is carried as part of the hood assembly, no structure will interfere with the manner in which the hood seats itself against the turret face of the turret and in this manner the hood and the supporting carriage in effect control the seating of the vacuum hood against the turret face thereby to insure a proper vacuum environment surrounding the food package. Furthermore, the heat sealing bar assembly has been improved by improving both the manner in which the heat sealing bar is pivotally mounted to the supporting yoke, as well as improving structure of the heat sealing bar itself. These improvements result in an improved heat sealing of the food package to insure that the resulting food package will be leak proof thereby to increase the shelf life of the resulting food package.

While there has been described herein what is at present considered to be the preferred embodiment of the invention, as indicated previously, various modifications may be made therein in connection with the construction of the various elements and parts whereby the above-outlined features are attained. It is nevertheless intended to cover in the appended claims all such modifications as fall within the true spirit and scope of the invention.

What is claimed is:

1. A multi-station packaging device for automatically packing a portion of a food product into a food container and performing all subsequent operations including filling, purging, and sealing the food container, and discharging the filled food container for further handling, comprising in combination, a support table, a turret mounted on said support table, said turret including a plurality of food container retention means, each of said retention means adapted to retain a single food container thereon, at least a first processing station positioned adjacent to said support table and in association with said turret, said first processing station including magazine means for carrying a plurality of food containers therein, and further including deposition means for retrieving a single food container from said magazine means and depositing said food container on said turret retention means, at least a second processing station positioned adjacent to said support table and in association with said turret, said second processing station including loading means for loading a pre-determined portion of a food product into said single food container, at least a third processing station positioned adjacent to said support table and in association with said turret, said third processing station including vacuum means positioned in operative cooperation with said corresponding retention means of said turret thereby to create vacuum environment surrounding said filled food container, purging means associated with said vacuum means for purging said food container with said food product contained therein, sealing means associated with said vacuum means for simultaneously sealing said food container while said food container and contained food product is in the purged condition and under vacuum conditions, discharge means for effecting the discharge of said food container with said food product contained therein from said retention means of said turret for further handling, and indexing means for effecting an indexing function between said turret relative to each of said processing stations such that said food container may be consecutively processed at each of said processing stations, whereby said packaging machine may be operated on an automatic and continuous basis to remove a single food container from said magazine means and position the same on said turret retention means, and said indexing means operating to effect a relative indexing function to occur such that said food container is consecutively processed at each consecutive food processing station to provide a filled, purged and sealed food container and discharging said food container from said retention means for further handling.

2. The packaging device as set forth in claim 1 above, wherein said turret having said plurality of food container retention means thereon moves relative to each of said processing stations, and said indexing means operates to effect the movement of said turret sequentially in response to the processing function of each processing station.

3. The packaging device as set forth in claim 1 above, wherein said packaging device further includes an imprinting processing station interposed between said first processing station and said second processing station, said imprinting station provided with imprinting means for imprinting pre-determined indicia on said food container prior to the operation of said loading means associated with said second processing station.

4. The packaging device as set forth in claim 1 above, wherein said packaging device further includes a food container discharge processing station interposed between said second processing station and said third processing station, said discharge station provided with discharge means for discharging an unfilled food container prior to the operation of said vacuum means associated with said third processing station.

5. The packaging device as set forth in claim 1 above, wherein said packaging device further includes an imprinting processing station interposed between said first processing station and said second processing station, said imprinting station provided with imprinting means for imprinting pre-determined indicia on said food container prior to the operation of said loading means associated with said second processing station, and further including a discharge processing station interposed between said second processing station and said third processing station said station provided with discharge means for discharging an unfilled food container prior to the operation of said vacuum means, whereby said packaging device includes at least five processing stations for depositing said food container on said turret retention means, imprinting said food container, filling said food container, purging said food container, sealing said food container, and discharging the food package from said turret retention means for further handling.

6. A multi-station packaging device for automatically packing a portion of food product into a food container and performing all subsequent operations including imprinting the food container, filling, purging, and sealing the food container, and discharging the filled food container for further handling, comprising in combination, a support table, a turret mounted on said support table, said turret including a plurality of food continer retention means, each of said retention means adapted to retain a single food container thereon, at least a first processing station positioned adjacent to said support table and in association with said turret, said first processing station including magazine means for carrying a plurality of food containers therein, and further including deposition means for retrieving a single food container from said magazine means and depositing said food container on said turret retention means, at least a second processing station positioned adjacent to said support table and in association with said turret, said second processing station including imprinting means for imprinting pre-determined indicia on said food container, at least a third processing station positioned adjacent to said support table in association with said turret, said third processing station including loading means for loading a pre-determined portion of a food product into a single food container, at least a fourth processing station positioned adjacent to said support table and in association with said turret, said fourth processing station including vacuum means positioned in operative cooperation with said corresponding retention means of said turret thereby to create a vacuum environment surrounding said filled food container, purging means associated with said vacuum means for purifying said food container with said food product contained therein, sealing means associated with said vacuum means for simultaneously sealing said food container while said food container and contained food products is in the purged condition and under vacuum conditions, discharge means for effecting the discharge of said food container with said food product contained therein from said retention means of said turret for further handling, and indexing means for effecting an indexing function between said turret relative to each of said processing stations such that said food container may be consecutively processed at each of said processing stations, whereby said packaging machine may be operated on an automatic and continuous basis to remove a single food container from said magazine means and position the same on said turret retention means, and said indexing means operates to effect a relative indexing function to occur such that said food container is consecutively processed at each consecutive food processing station to provide an imprinted, filled, purged and sealed food container, and discharging said food container from said retention means for further handling.

7. The packaging device as set forth in claim 6 above, wherein said turret having said plurality of food container retention means thereon moves relative to each of said processing stations, and said indexing means operates to effect the movement of said turret sequentially in response to the processing function performed at each of said processing stations.

8. The packaging device as set forth in claim 7 above, wherein each of said processing stations is fixedly mounted on said support table and in circumferentially spaced relation one with respect to the other.

9. The packaging device as set forth in claim 7 above, wherein said food container comprises a plasticized food puouch having sealed sides and a sealed bottom, and an open top end.

10. The packaging device as set forth in claim 9 above, wherein said food container retention means comprises a turret face having at least a pair of jaw means for removeably engaging a single food pouch at the opposed side edges thereof whereby upon deposition of said food pouch upon said turret face, said jaw means operates to removeably engage said pouch in preparation for the processing functions at each of the consecutively arranged processing stations.

11. The packaging device as set forth in claim 10 above, wherein said magazine means comprises a hopper constructed to contain a plurality of plasticized food pouches in vertically stacked orientation.

12. The packaging device as set forth in claim 11 above, wherein said hopper further includes universal adjustment means for permitting the adjustment of said hopper relative to said food container retention means positioned on said turret.

13. The packaging device as set forth in claim 10 above, wherein said deposition means comprises a reciprocating head pivotally mounted on a support frame and provided with pouch arresting means, said reciprocating head constructed to reciprocate said pouch arresting means into contact with a single food pouch in said magazine means and to deposit said pouch on said pair of jaw means of said turret face thereby to prepare said food pouch for further processing.

14. The packaging device as set forth in claim 6 above, wherein said loading means comprises a food chute for receiving a pre-determined portion of a food product, scoop means positioned adjacent said chute for accepting said food product from said chute, and ram means associated with said scoop means for positively inserting said food product into said food container.

15. The packaging device as set forth in claim 14 above, wherein said scoop means comprises at least a pair of scoop arms reciprocably mounted on said second processing station for reciprocatingly positioning said food product received from said food chute into said food container, and said ram means comprises a ram mounted for reciprocating movement through said scoop arms to positively remove said food product from said scoop arms and insert the same into said food container, said scoop arms and ram being in operative cooperation one with respect to the other whereby said scoop arms will automatically reciprocate into said food container and said ram will simultaneously reciprocate through said scoop arms to positively remove said food product from said scoop arms and insert the same into said food container.

16. The packaging device as set forth in claim 6 above, wherein said vacuum means comprises a vacuum hood reciprocably mounted on said third processing station and constructed to reciprocate into a surrounding position about said food container retention means having said food container carried thereon for creating a vacuum environment about said food container and food product contained therein, said vacuum hood further including self positioning adjustment means to permit said vacuum hood to adjust along both the vertical and horizontal axis relative to said food container retention means thereby to achieve an improved fluid tight seal between said vacuum hood and said food container retention means whereby the vacuum environment achieved is leak-proof.

17. The packaging device as set forth in claim 16 above, wherein said purging means comprises a source of nitrogen gas carried on said vacuum hood and operating to purge said container and food product contained therein of substantially all remaining air while said container and food product are under vacuum conditions, said source of nitrogen gas being in operative cooperation with said vacuum hood such that the source of nitrogen gas is actuated to operate only after the vacuum environment has been established.

18. The packaging device as set forth in claim 17 above, wherein said sealing means comprises a heat-sealing bar pivotally mounted on a reciprocable support yoke, said reciprocable support yoke being mounted on said vacuum hood, whereby said vacuum hood carries said source of nitrogen gas and said heat sealing bar as an integral part thereof such that said vacuum hood may be reciprocated into operative contact with said food container retention means, said self-positioning adjustment means operating to insure an improved vacuum environment, and said purging means and sealing means operating only after said improved vacuum environment has been established thereby to insure the improved purging of said food container and food product contained therein, as well as to insure the improved sealing of said food container thereafter.

19. The packaging device as set forth in claim 6 above, wherein said indexing means includes electrical circuitry in electrical communication with said turret and with each of said processing stations whereby said electrical circuitry is actuated by the mechanical movement of each of said processing stations in sequential and consecutive order thereby to sequentially rotate said turret in response to the processing function of each processing station in order to effect a sequential processing of said food container and food product contained therein in order to produce an imprinted, filled, purged, and sealed food package.

20. The packaging device as set forth in claim 6 above, wherein said packaging device further includes a food container discharge processing station interposed between said third processing station and said fourth processing station, said discharge station provided with discharge means for discharging an unfilled food container prior to the operation of said vacuum means associated with said fourth processing station.

21. A multi-station packaging device for automatically packing a portion of food product into a food container, and performing all subsequent imprinting, filling, purging and sealing operations, and discharging the food package for further handling, comprising in combination, a support table, a turret rotatably mounted on said support table, said turret including a series of six turret faces circumferentially spaced about the periphery of said turret, each of said turret faces provided with backup plates and including reciprocating means for reciprocating said backup plates between a forward support position and a rearward rest position, each of said turret faces further provided with retention means for accepting and retaining a single food container on said turret face, at least a first fixed processing station provided in association with said support table and rotatable turret, said first processing station including magazine means for carrying a plurality of food containers therein, and depositing means positioned in association with said magazine means for arresting a single food container from said magazine means and depositing the same on a corresponding turret face, at least a second fixed processing station provided in association with said support table and rotatable turret and circumferentially spaced from said first processing station, said second processing station including activating means for activating said reciprocating means of said backup plates to reciprocate said corresponding backup plate to a forward support position behind said food container and further including imprinting means for imprinting pre-determined indicia on said food container while said backup plate is in the forward support position, said second processing station further including container opening means for opening said food container to its substantial dimension, at least a third fixed processing station provided in association with said support table and rotatable turret and circumferentially spaced from said second processing station, said third processing station including food reception means thereby to receive and accept a predetermined quantity of a food product, and further including loading means associated with said reception means for loading said pre-determined quantity of food product received from said reception means into said opened food container, at least a fourth fixed processing station provided in association with said support table and rotatable turret and circumferentially spaced from said third processing station, said fourth processing station including vacuum means positioned in operative cooperation with said corresponding turret face having said filled food container carried thereon thereby to create a vacuum environment surrounding said filled food container, purging means associated with said vacuum means for purifying said food container and food product contained therein, sealing means associated with said vacuum means for simultaneously sealing said food container while in the purged state and under vacuum conditions, discharge means associated with said support table and positioned in operative cooperation with said corresponding turret face having said filled, purged, and sealed food container thereon for effecting the discharge of said food container from said turret face for further handling, and indexing means in operative communication with said turret and with each of said processing stations and said discharge means, said indexing means operating to rotate said turret sequentially from said first processing station to each next adjacent circumferentially spaced processing station and to said discharge means in response to the completion of each processing step at each of said stations, whereby said packaging machine may be operated on an automatic and continuous basis to remove a single food container from said magazine means and position the same on a turret face on said turret, and said indexing means operating to rotate said turret to each of said processing stations consecutively and to said discharge means thereby to provide a filled, purged, and sealed food container which may then be discharged for further handling.

22. The packaging device as set forth in claim 21 above, which further includes a food container discharge station interposed between said third processing station and said fourth processing station, said discharge station provided with discharge means for discharging an unfilled food container, prior to the operation of said vacuum means associated with said fourth processing station.

23. A multi-station packaging device for automatically packing a portion of food product into a food container and performing all subsequent operations including imprinting, filling, purging, sealing, and discharging the finished food package for further handling, comprising in combination, a support table, a turret rotatably mounted on said support table, said turret including a series of six turret faces circumferentially spaced about the periphery of said turret, each of said turret faces provided with a back-up plate and including reciprocating means for reciprocating said back-up plate between a forward support position and rearward rest position, each of said turret faces further provided with retention means for accepting and retaining a single food container on said turret face, at least a first fixed processing station provided in association with said support table and rotatable turret, said first processing station including magazine means for carrying a plurality of food containers therein, and deposition means positioned in association with said magazine means for arresting a single food container from said magazine means and depositing the same on a corresponding turret face, at least a second fixed processing station provided in association with said support table and rotatable turret and circumferentially spaced from said first processing station, said second processing station including activating means for activating said reciprocating means of said backup plates to reciprocate said corresponding backup plate to a forward support position behind said food container, and further including imprinting means for imprinting pre-determined indicia on said food container while said backup plate is in the forward support position behind said food container, said second processing station further including container opening means for opening the open top end of said food container to its substantial dimension, at least a third fixed processing station provided in association with said support table and rotatable turret and circumferentially spaced from said second processing station, said third processing station including food reception means thereby to receive and accept a predetermined quantity of a food product, and further including loading means for loading said pre-determined quantity of food product received from said reception means into said opened food container, at least a fourth fixed processing station provided in association with said support table and rotatable turret and circumferentially spaced from said third processing station, said fourth processing station including discharge means for discharging an unfilled food container from said turret face, at least a fifth processing station provided in association with said support table and rotatable turret and circumferentially spaced from said fourth processing station, said fifth processing station including vacuum means positioned in operative cooperation with said corresponding turret face having said filled food container carried thereon thereby to create a vacuum environment surrounding said filled food container, purging means associated with said vacuum means for purging said food container and food product contained therein, sealing means associated with said vacuum means for sealing said food container while in the purged state and under vacuum conditions, at least a sixth fixed processing station provided in association with said support table and rotatable turret and circumferentially spaced from said fifth processing station, said sixth processing station including discharge means for effecting the discharge of said filled, purged and sealed food container from said retention means provided on said turret face for further handling, and indexing means in operative communication with said turret and with each of said processing stations, said indexing means operating to rotate said turret sequentially from said first processing station to each next adjacent circumferentially spaced processing station in response to the completion of each processing function at each of said processing stations, whereby said packaging machine may be operated on an automatic and continuous basis to remove a single food container from said magazine means and position one of said food containers on each of said turret faces, and said indexing means operating to rotate said turret to each of said processing stations consecutively thereby to provide a filled, purged and sealed food container which may then be discharged for further handling.

24. A multi-station packaging device for automatically packing a portion of a food product into a food container pouch of the type having sealed sides, a sealed bottom, and an open top end, and performing all subsequent operations including imprinting, filling, purging, sealing and discharging the finished food package for further handling, comprising in combination, a support table, a turret rotatably mounted on said support table, said turret including a series of six turret faces circumferentially spaced about the periphery of said turret, each of said turret faces provided with a back-up plate and including reciprocating gear means for reciprocating each of said back-up plates between a forward support position and a rearward rest position, each of said turret faces further provided with at least a pair of pouch retention jaw means for accepting and retaining a food pouch on said corresponding turret face, a first fixed processing station mounted on said support table and positionally associated with said rotatable turret, said first processing station including pouch magazine means for carrying a supply of food pouches therein and in vertically stacked orientation, said first processing station further including pouch arresting and deposition means associated with said pouch magazine means for arresting a single food pouch from the bottom of said vertically stacked pouches in said magazine means and depositing said pouch in said pouch retention jaw means on said corresponding turret face, a second fixed processing station mounted on said support table, positionally associated with said rotatable turret and circumferentially spaced from said first processing station, said second processing station including activating means for activating said reciprocating gear means of said corresponding turret face to reciprocate said back-up plate to a forward support position behind said arrested food pouch on said pouch retention jaw means, said second processing station further including imprinting means operating to imprint pre-determined indicia on said arrested and supported food pouch, said second processing station additionally including food pouch opening means for opening the top end of said food pouch to its substantial dimension, a third fixed processing station mounted on said support table, positionally associated with said rotatable turret, and circumferentially spaced from said second processing station, said third processing station including food reception means for receiving and accepting a pre-determined quantity of a food product, food loading means carried by said third processing station and associated with said food reception means for receiving said food product from said food reception means unloading said food product into said food pouch while said food pouch is arrested and supported on said corresponding turret face, said third processing station further including sensing means associated with said food reception means for sensing the presence of a food product prior to loading the same into said food pouch and to actuate said loading means, and to sense the absence of the food product prior to loading the same into said food pouch thereby to prevent operation of said loading means, said third processing station further including pouch sensing means for sensing a properly opened pouch and activating said loading means in response to the presence of a properly opened pouch and to restrain said loading means in response to the presence of an improperly opened pouch, a fourth fixed processing station mounted on said support table, positionally associated with said rotatable turret, and circumferentially spaced from said third processing station, said fourth processing station including discharge means for discharging an unloaded food pouch, a fifth fixed processing station mounted on said support table, positionally associated with said rotatable turret, and circumferentially spaced from said fourth processing station, said fifth processing station including vacuum hood means positioned in operative cooperation with said corresponding turret face thereby to create a vacuum environment surrounding said filled food pouch carried on said turret face, purging means carried by said vacuum hood means and operating to purge said food pouch and food product contained therein after said vacuum environment has been established, heat sealing means carried by said vacuum hood means for heat sealing said food pouch while in the purged state and under vacuum conditions, a sixth fixed processing station mounted on said support table, positionally associated with said rotatable turret, and circumferentially spaced from said fifth processing station, said sixth processing station including discharge means positioned for operative cooperation with said pouch retention jaw means for discharging said imprinted, filled, purged, and sealed food pouch from said pouch retention jaw means for further handling, an indexing means in operative communication with said rotatable turret and with each of said processing stations, said indexing means operating to rotate said turret sequentially from said first processing station to each next adjacent circumferentially spaced processing station in response to the completion of each processing step at each of said processing stations, whereby said packaging machine may be operated on an automatic and continuous basis to remove a single food pouch from said magazine means and position the same on a corresponding turret face on said turret, and said indexing means operating to rotate said turret to each of said processing stations sequentially, such that each of said six turret faces is provided with a food pouch to be imprinted, filled, purged, sealed, and discharged, and said turret continually rotates to effect the processing of food pouches to a completed food package on a continuous basis.

25. The packaging device as set forth in claim 24, wherein said reciprocating gear means comprises a rack and pinion assembly interconnecting the upper portion of said backup plate with said turret in operative communication with said indexing means, whereby upon actuation by said indexing means, the upper portion of said backup plate is reciprocated into a forward support position behind said food pouch carried on said turret.

26. The packaging device as set forth in claim 24 above, wherein said bag retention jaw means comprises a pair of jaw clamps, one of each of said jaw clamps carried on the corresponding jaw arm, said jaw arms being pivotally joined by a pawl thereby to accommodate a degree of lateral movement of said jaw clamps toward and away from each other respectively such that a food pouch held by said jaw clamps may be alternately stretched and slackened depending upon the respective positions of said jaw arms.

27. The packaging device as set forth in claim 24 above, wherein said pouch magazine means comprises a hopper constructed for accommodating a plurality of food pouches in vertically stacked orientation, said hopper further provided with universal adjustment means for adjusting the dimensional spacing of said hopper relative to said corresponding turret face whereby said hopper may be properly positioned in order to accommodate the proper placement of a pouch from said hopper onto said turret.

28. The packaging device as set forth in claim 27 above, wherein said pouch arresting and deposition means comprises a reciprocating head pivotally mounted on a support frame and provided with pouch arresting means, said pouch arresting means formed by at least one vacuum cup, whereby a single food pouch may be arrested from said hopper by reciprocating said reciprocating head and said vacuum cup to a position adjacent the bottom of said hopper, arresting one of said food pouches by applying a vacuum to said vacuum cup, and reciprocating said reciprocating head into a depositing posture with respect to said turret such that said single food pouch arrested from said hopper may be deposited onto said pouch retention jaw means on said turret.

29. The packaging device as set forth in claim 24 above, wherein said pouch opening means comprises a pair of air jets, one of said air jets being positionally mounted on said second processing station to direct a jet of air against a rear lip of said open top end of said food pouch thereby to arrest the rear wall of said food pouch, and the other of said air jets being positionally mounted on said second processing station to direct a jet of air directly into said food pouch thereby to open said pouch to its substantial dimension.

30. The packaging device as set forth in claim 24 above, wherein said food reception means comprises a chute for receiving a pre-determined quantity of a food product, and said food loading means comprises a pair of scoop arms reciprocably mounted on said third processing station for reciprocatingly positioning said food product received from said chute into said food pouch, and further including a ram mounted for reciprocating movement through said scoop arms to positively insert said food product into said food pouch.

31. The packaging device as set forth in claim 24 above, wherein said sensing means comprises a photoelectric cell positionally mounted to detect the presence and absence of a food product in said food reception means and to prevent operation of said loading means until food product is sensed.

32. The packaging device as set forth in claim 24 above, wherein said pouch sensing means comprises a pair of horizontally aligned photoelectric transmitters and receivers which operate to sense the presence of a properly opened pouch and to activate said loading means in response to the presence of a properly opened pouch, and to sense the presence of an improperly pouch and to restrain said loading means from loading food product into said pouch in response to the presence of the improperly opened food pouch.

33. The packaging device as set forth in claim 24 above, wherein said vacuum hood means comprises a vacuum hood mounted on a carriage, said carriage mounted for reciprocating movement relative to said turret face and including self-positioning adjustment means to permit said carriage and said vacuum hood to adjust along both the vertical and horizontal axes relative to said pouch retention jaw means and constructed to reciprocate into a surrounding position about said turret face having said food pouch carried thereon for creating a vacuum environment about said food pouch and food product contained therein, whereby upon reciprocation of said carriage, said vacuum hood will move into surrounding contact with said turret face while said self-positioning adjustment means accommodates a leakproof seal to be formed between said vacuum hood and said turret face in order to insure proper purging and sealing of said food pouch.

34. The packaging device as set forth in claim 33 above, wherein said purging means comprises a source of nitrogen gas mounted on said vacuum hood and being moveable in response to the movement of said vacuum hood, and operating to purge said food pouch and food product contained therein of all remaining air while said food pouch and food product are under vacuum conditions.

35. The packaging device as set forth in claim 34 above, wherein said heat sealing means comprises a heat sealing bar pivotally mounted on a reciprocable support yoke, said reciprocable support yoke being mounted on said vacuum hood, whereby said vacuum hood carries said source of nitrogen gas and said heat sealing bar as an integral part thereof such that said vacuum hood may be reciprocated into operative contact with said turret face while the self-positioning adjustment means operates to insure an improved vacuum environment surrounding said food pouch and food product contained therein thereby to permit efficient operation of said purging and sealing means while under vacuum conditions.

36. The packaging device as set forth in claim 24 above, wherein said discharge means comprises a pair of discharge rams positionally mounted to actuate said pouch retention jaw means upon completion of said imprinting, filling, purging, and sealing functions thereby to discharge said food package from said turret face of said turret.

37. In an improved food packaging device of the type formed by a support table, a turret mounted on said support table, and a plurality of food package processing stations operationally associated with said turret and further including indexing means such that an indexing function is achieved between said turret and said food package processing stations, an improved vacuum hood assembly, comprising in combination, a support frame, a carriage mounted on said support frame for reciprocating movement toward and away from the turret carrying the food package to be processed, said carriage including self-positioning adjustment means for effecting both the lateral and vertical adjustment of said carriage and said vacuum hood carried thereon relative to said turret, said vacuum hood further including purging means mounted thereon and moveable in response to the movement of said vacuum hood, said vacuum hood further including heat sealing means mounted thereon and moveable in response to the movement of said vacuum hood, whereby said carriage carrying said vacuum hood permits the universal seating of said vacuum hood relative to the turret face in order to insure a leakproof vacuum environment surrounding the food package carried on the turret, all other operational structures including said purification means and said heat sealing means being carried by said hood such as to avoid interference with the manner in which said hood seats itself against said turret in order to insure a leak-proof vacuum condition surrounding said food package.

38. The improved packaging device as set forth in claim 36, wherein said self-positioning adjustment means comprises a plurality of ball rollers mounted on and carrying said carriage, and further includes a central pivot point at the approximate mid-position of said carriage, said central pivot point accommodating the arcuate movement of said carriage and said vacuum hood mounted thereon whereby said plurality of ball rollers permit the carriage movement along the horizontal axis relative to said turret while said pivot point permits said carriage on said hood vertical and arcuate movement of said carriage and said hood relative to said turret in order to insure the seating of said vacuum hood against said turret.

39. In an improved food packaging device of the type formed by a support table, a turret mounted on said support table, and a plurality of food package processing stations operationally associated with the turret and further including indexing means such that an indexing function is achieved between the turret and the food package processing station, an improved heat sealing bar assembly, comprising in combination, a support yoke, said support yoke provided with opposed support flanges, a heat sealing bar interposed between said support flanges and pivotally secured thereto, said pivotal mounting of said heat sealing bar to said opposed support flanges being arranged at the upper front face of said heat sealing bar whereby said heat sealing bar is pivotally mounted adjacent the upper front edge thereof.

40. The improved heat sealing bar assembly as set forth in claim 39 above, wherein said heat sealing bar is formed by a solid bar having a central core section and bounded by a front heat sealing face, a rear face, and upper and lower faces, said rear face including a groove extending the entire lateral dimension of said heat sealing bar and traversing said heat sealing bar from said rear face thereof to said central core portion whereby said rear portion of said heat sealing bar is formed by a pair of opposed rear sections, said heat sealing further provided with a plurality of clamping means positioned along the lateral dimension of said opposed pair of rear portions such that upon clamping said rear portions, the internal dimensions of said central core portion can be constricted into tight fitting engagement with a heat cartridge inserted therethrough, said clamping means for clamping said opposed pair of rear portions further functioning to operate as jack means for extending said pair of opposed rear portions thereby to increase the internal dimensions of said central core portion to permit the withdrawal of said heat cartridge from said central core portion.

41. The heat sealing bar as set forth in claim 40 above, wherein said clamping means comprises a plurality of threaded screws, screw-threadedly mounted in screw holes provided through said opposed pair of rear portions, and one of said rear portions provided further with a series of threaded jack holes, whereby threaded screws inserted through said threaded jack holes will strike against the opposed one of said pair of opposed rear portion and effect a spreading of said pair of rear portion in opposed directions thereby to enlarge the opening of said central core portion and permit the easy insertion and withdrawal of a heat bar therethrough.

42. The heat sealing bar as set forth in claim 41 above, wherein said sealing bar is further provided with a pair of opposed stress slots extending across the lateral dimension thereof from one side edge to the opposed side edge, said stress slots accommodating and facilitating the constriction and spreading of said opposed pair of rear portion to alternately engate and disengage the heat cartridge from within said central core portion.

* * * * *